US005909736A

United States Patent [19]

Stavridis et al.

[11] Patent Number: 5,909,736

[45] Date of Patent: Jun. 8, 1999

[54] REMOVAL OF NOXIOUS OXIDANTS AND CARCINOGENIC VOLATILE NITROSOCOMPOUNDS FROM CIGARETTE SMOKE USING BIOLOGICAL SUBSTANCES

[76] Inventors: Ioannis Stavridis, 15 Chremonidou Street, Athens, Greece, GR-166 33; George Deliconstantinos, 40-44 Ilidos Street, Athens, Greece, GR-115 27

[21] Appl. No.: 08/602,821

[22] PCT Filed: Jun. 27, 1994

[86] PCT No.: PCT/GR94/00015

§ 371 Date: May 24, 1996

§ 102(e) Date: May 24, 1996

[87] PCT Pub. No.: WO96/00019

PCT Pub. Date: Jan. 4, 1996

[51] Int. Cl.[6] ..... A24B 15/00

[52] U.S. Cl. ..... 131/331; 131/334

[58] Field of Search ..... 131/334

[56] References Cited

U.S. PATENT DOCUMENTS

| | | |
|---|---|---|
| 3,982,897 | 9/1976 | Scheinberg . |
| 4,049,673 | 9/1977 | Scheinberg . |
| 4,612,333 | 9/1986 | Vassileff . |

FOREIGN PATENT DOCUMENTS

| | | |
|---|---|---|
| 438789 | 5/1985 | Norway . |
| 439116 | 6/1985 | Norway . |
| 609217 | 2/1979 | Switzerland . |
| 2083998 | 4/1982 | United Kingdom . |
| WO 82/02820 | 2/1982 | WIPO . |

OTHER PUBLICATIONS

Bednarcyk, Norman E., "Tobacco Smoke Filters", pp. 252–264 (Noyes Data Corporation, Park Ridge, New Jersey 1972).

Derwent Publications, Ltd., London, GB, AN 82–84398E & JP, A, 57 138 375 (KOWA KK) (Aug. 26, 1982) (abstract).

Derwent Publications, Ltd., London, GB, AN 88–288470 & JP, A, 63209 718 (UBE Industries Ltd.) (Aug. 31, 1988) (abstract).

Derwent Publications Ltd., London, GB, AN 83–726087 & JP, A, 58 107 166 (Advance Kaihatsu) (Jun. 25, 1983) (abstract).

*Patent Abstracts of Japan* 14 (118) (Mar. 6, 1990) & JP, A, 01 317 538 (Asahi Chem. Ind. Co. Ltd.) (Dec. 22, 1989) (abstract).

Baumgartner pamphlet: "Baumgartner's Current Range of Cigarette Filters" (available before Jun. 27, 1993).

*Primary Examiner*—Mickey Yu
*Assistant Examiner*—Kelly O'Hara
*Attorney, Agent, or Firm*—Arnall Golden & Gregory, LLP

[57] ABSTRACT

This invention refers to a method of withholding noxious compounds contained in cigarette smoke (NO, NOx, carcinogenic nitrosocompounds, free radicals, $H_2O_2$, CO, aldehydes, and trace elements) which were up to today insufficiently retained by conventional cigarette filters. The method described specifically refers to the enrichment of common convention filters with biological substances of the metal ions ($Fe^{2+}$, $Cu^{2+}$, $Mg^{2+}$) complexed with porphirin ring as well as $Fe^{2+}$ ions stereospecifically bound to protein molecules, either separately or in combinations. The enrichment of these conventional filters with the abovementioned biological substances alters neither the physical properties of the cigarette smoke (odor, taste and appearance) nor the physical properties of the filter itself.

25 Claims, 15 Drawing Sheets

Figure 1:
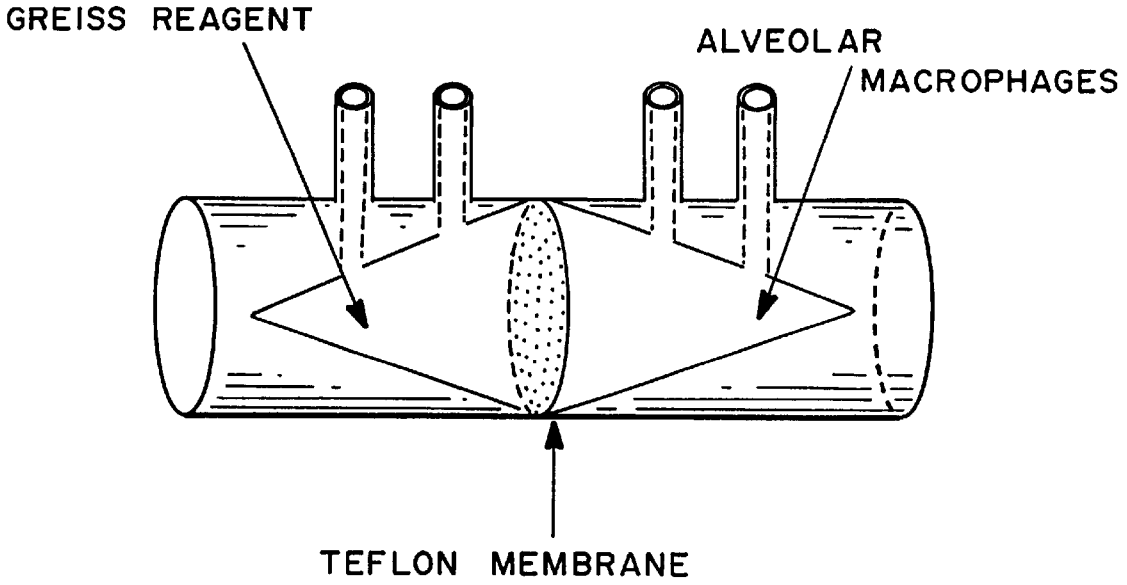

REMOVAL OF NOXIOUS OXIDANTS AND CARCINOGENIC VOLATILE NITROSOCOMPOUNDS FROM CIGARETTE SMOKE USING BIOLOGICAL SUBSTANCES

The present invention establishes a methodology for withholding the noxious compounds, ie. nitrogen oxides, free radicals, aldehydes, hydrogen peroxide, carbon monoxide, trace elements and carcinogenic volatile nitrosocompounds from being inhaled during cigarette smoking, substances which until today are insufficiently retained by the use of conventional cigarette filters.

THEORETICAL BACKGROUND-LEVEL OF PREVIOUS TECHNOLOGY

A plethora of publications in international journals suggests that cigarette smoke is separated into two phases: a) a solid phase (tar); and b) a gas phase. This separation occurs with the use of a typical Cambridge-glass-fiber filter which withholds 99.9% of the particles which are greater in size than 0.1 $\mu$m. The tar of the cigarette contains dramatically high concentrations of very stable free radicals which can be classified into at least four different categories. Semiquinones in equilibrium with quinone and hydroxyquinones are considered to be free radicals with most interesting chemical properties. The quinone system reduces the molecular oxygen to form superoxide ($\mathbf{0}_2^-$) which then upon spontaneous dismutation forms hydrogen peroxide ($H_2O_2$). In the gas phase, there are more than $10^{15}$ organic radicals per puff with half-lives of less than 1 second that are inhaled. It is paradoxical however that despite their minute half life these radicals can maintain high levels of activity for more than 10 minutes in the gas phase. In fact the concentration of these radicals is considerably increased as we approach the filter-end of the cigarette. An explanation for this paradox is to be found in the maintenance of a steady state situation; due to the ongoing production of free radicals (Pryor, W. A., Stone, K., Ann. N.Y. Acad. Sci. 686: 12–28, 1993).

Nitric oxide (NO) is the most important free radical in the gas phase of the cigarette smoke which, during smoking, participates in a sequence of reactions through which nitrogen dioxide, isoprene radicals, peroxyl radicals and alkoxyl radicals are formed. Cigarette smoke also contains a considerable number of aldehydes which contribute to its damaging toxic effects. It has been shown that minute amounts of aldehydes extracted from the cigarette smoke cause both protein catabolism and oxidation of thiol groups of the plasma proteins. These properties attributed to the aldehydes are the result of the reactions between the carbonyl group of the aldehydes and the —SH and —NH2 groups of the plasma proteins. For example, acroleine, from the cigarette smoke, reacts quickly with the —SH groups to form carbonyl compounds (Alving, K., Forhem, C., and Lundberg, J. M., Br. J. Pharmacol. 110: 739–746, 1993). In the tar of the cigarette smoke there are trace elements of, for example, iron, copper, manganese and cadmium which are implicated in many free radical producing reactions and lead to the formation of very active secondary radicals (e.g. peroxy radicals, alkoxy radicals, superoxide, cytotoxic aldehydes etc.). The introduction of the trace elements into the lung during cigarette smoking leads to a series of redox reactions both in lung fluids and alveolar macrophages which result in the formation of the very active hydroxyl radicals (OH—). These hydroxyl radicals are mainly formed in the presence of iron via the Fenton reaction. Copper can also form hydroxyl radicals by reacting with the hydrogen peroxide in the lung. Manganese, in low concentrations ($10^{-7}$M), stimulates the soluble guanylate cyclase of the endothelial cells of the lung causing the production of nitric oxide and superoxide through a positive feedback mechanism (Youn, Y. K., Lalonde, C., and Demling, R., Free Rad. Biol. Med. 12: 409–415, 1992). Carbon monoxide is produced during tobacco burning. A quantity of CO is retained in the lung even after exhaling, resulting in the stimulation of the soluble guanylate cyclase after its interaction with the heme moiety of the enzymes of the endothelial cells and other cells of the lung tissue. The increased levels of cyclic GMP within the cells coupled with a positive feed back mechanism increase the production of nitric oxide and superoxide Watson, A., Joyce, H., Hopper, L., and Pride, N. B., Thorax 48: 119–124, 1993). NO gas which can be produced by numerous cell types, including the vascular endothelial cells and reticular endothelial cells, causes relaxation of the smooth muscle (Lowenstein, C. J., Dinerman, J. L., Snyder, S. H. Ann. Intern. Med. 120: 227–237, 1994). There are also exogenous sources of NO which are considered similarly responsible in causing damage to the blood vessels and other tissues. It is well established that secondary and tertiary amines can react with nitrite and other nitrosating agents to form N-nitrosoamines (Lowenstein, C. J., Dinerman, J. L., Snynder, S. H. Ann Intern. Med. 120: 227–237, 1994). Since 1974 a number of studies have demonstrated that during harvesting, tobacco processing and smoking the alkaloids are nitrosated to tobacco specific N-nitrosamines (TSNA). Of the TSNA identified in tobacco and/or its smoke, N-nitrosonornicotine (NNN), 4-(methylnitrosoamino)-1-(3-pyridyl)-1-butanone (NNK) and 4-(methylnirosamino)-1-(3-pyridyl)-1-butanol (NNAL) are strong animal carcinogens. NNN induces tumor of the lung in mice, tumors of the trachea in hamsters, and tumors of the nasal cavity and esophagus in rats. NNK induces tumors of the lung in mice, hamsters and rats, and also tumors of the liver, nasal cavity and pancreas in rats. Oral swabbing of a mixture of NNN and NNK elicits tumors in the oral cavity and lung of rats. The typical amount of both NNK and NNN in mainstream cigarette is 200 ng/cigarette. (Hecht, S. S., Spratt, T. E., and Trushin, N. Carcinogenesis, 9: 161–165, 1988).

Our present research, related to the effect of the cigarette smoke on lung tissue has revealed that NO reacts with superoxide to form the strong oxidant radical peroxynitrite (ONOO—) which causes secondary damaging reactions in key biomolecules. Both the metabolic and damaging effects of the NO in the cells were studied in our lab in vitro and in vivo experiments.

NO is oxidized, in the presence of oxygen, to nitrogen dioxide ($NO_2$). The rate of this oxidation depends upon the concentration of oxygen and the square of the NO concentration. Nitrogen dioxide is clearly cytotoxic and is transformed into nitrite and nitrate when in water solutions. Moreover NO forms complexes with trace elements and/or with metalloproteins, hemoglobin for example (Wink, D. A., Darbyshire, J. F., Nims, R. W., Saavedra, J. E., and Ford, P. E., Chem. Res. Toxicol. 6: 23–27, 1993).

NO that reacts with superoxide to form the noxious compound $ONOO^-$ can justify certain types of superoxide toxicity. $ONOO^-$ is unusually stable, taking into consideration its strong oxidative potential (+1.4 V). During its decomposition it forms strong oxidative derivatives including the hydroxyl radical, the nitrogen dioxide and the nitronium ion. Consequently any modification in the NO and superoxide production by the tissues can lead to the formation of strong secondary oxidative radicals (Deliconstantinos, G., Villiotou, V., Stavrides, J. C., Cancer Mol. Biol. 1: 77–86, 1994). Finally $ONOO^-$ and its esters (RO—ONO or RO—ON$0_2$) tend to cause inactivation of the alpha -1-proteinase inhibitor (a1PI). This can be justified by the facts that: a) the hydrogen peroxide alone does not cause quick inactivation of the a1 PI but acts only in the presence of NO whereupon $ONOO^-$ is formed and quick inactivation of the a1PI occur, b) solutions of tert-boutyl peroxynitrite (RO—O—O—$NO_2$) or $ONOO^-$ cause inactivation of a1PI by themselves, and c) amines and amino acids protect the a1PI proteinase from quick inactivation (Moreno, J. J., and Pryor, W. A., Chem. Res. Toxicol. 5: 425–431, 1992). Apart from the free radicals contained in the cigarette smoke the activated alveolar macrophages represent another important source of free radical production by smokers. The alveolar macrophages activated by cigarette smoke undergo a respiration burst resulting in increased production of oxygen free radicals (mainly $O_2^-$, NO and $H_2O_2$). Smokers appear to have an increased number of both alveolar macrophages and circulating neutrophiles. The oxygen free radicals of the cigarette smoke have also been implicated in the development of lung cancer. The inhaled cigarette smoke causes increased oxidative stress in the lung cells resulting in the reduction in the concentration of the intracellular antioxidants. $H_2O_2$ reacts, through the production of hydroxyl radicals, with the DNA of the cells and causes a break in the double strand. As this break can be prevented by the addition of catalase, this indirectly confirms the damaging effects of $H_2O_2$ and the hydroyl radicals on cellular DNA (Leanderson, P., Ann. N.Y. Acad. Sol. 686: 249–261, 1993). Furthermore $H_2O_2$ can cause transformation in the tracheal epithelium of the lung and has been linked to the development of bronchogenic carcinoma in smokers. Thus the detrimental role of $H_2O_2$ (contained in the cigarette smoke) in the lung cells and in the development of lung cancer is strongly suggested. The tar from cigarette smoke contains both semiquinone radicals and iron thus creating a system for hydroxyl radical production. The various trace elements contained in the tar of the cigarette smoke (Fe, Cu, Mn, Cd) can act both intracellularly and extracellularly. The $Fe^{2+}$ with the well Known Fenton reaction:

$$Fe^{2+}+H_2O_2 \rightarrow Fe^{3+}+OH+OH^-$$

causes a plethora of oxidative reactions through hydroxyl radicals. Similar production of hydroxyl radical can be achieved by $Cd^{2+}$. $Mn^{2+}$ is a characteristic stimulator of soluble guanylate cyclase activity. $Cd^{2+}$ contained in the cigarette smoke is exceptionally toxic to the lung. Smokers appear to have twice the normal concentration of $Cd^{2+}$ in their lungs. It is suggested that $Cd^{2+}$ displaces $Zn^{2+}$ in presentation of normalcy in the endothelium of the lung vessels (Kostial, K., In: "Trace Elements in Human and Animal Nutrition" (ed. W. Mertz) Fifth edit. Vol. 2: 319–345, Academic Press, Inc. Orlando, Fla., 1986). Aldehydes, present in the cigarette smoke, react with the —SH and —$NH_2$ groups of the proteins ultimately to become inert. Crotonaldehyde ($\alpha$, $\beta$ unsaturated aldehyde contained in cigarette smoke decreases the concentration of the —SH groups and increases the concentration of the carbonyl proteins (Stadtman, E. R., Science 257: 1220–1224, 1991).

Today filters on cigarettes are strongly recommended. The ulimate aim in adding filters to the cigarette is to achieve the maximum retention of noxious compounds present both in the gas and solid phases of the cigarette smoke. Epidemiological studies in smokers have shown that there was a dose-dependent response regardless of whether the cigarette smoke was administered in the gas phase, the solid phase or the solid phase or the combined phase (Surgeon General of the U.S. Public Health Service. The health consequences of using smokeless tobacco, N.H. Publ. No 86-2874, Bethesda, Md., 1986). It was proven that modification of the cigarette is in itself a practical approach to reducing the noxious compounds contained in cigarette smoke. This was initially achieved using common filters and then by changing the composition of the tobacco through chemical processing. Changes in the manufacturing of the cigarettes were also made with the use of porous paper or paper made of tobacco leaves. In the last 15 years many attempts have been made to make smoking less damaging to ones health by: reducing the quantity of the smoke per cigarette: changing the diameter of the cigarette; and by using perforated filters. Perforated filters allow for the dilution of cigarette smoke with air to up to 50%. Activated charcoal has also been used in combination with perforated filters. This has contributed to drastic reduction in smoke yields of tar and nicotine. Such techniques are being used particularly in the developed countries like Austria, Canada, France, Germany, Sweden, England and the U.S.A. The average yield of tar and nicotine in an American cigarette was reduced from 38 mg and 2.7 mg in 1955 to 13 mg and 1 mg in 1991 respectively. In the European Community this trend towards reduction in the yields of tar and nicotine in cigarette smoke is still being continued. The upper allowable limit for tar as of January 1993 is 15 mg which is to be reduced to 12 mg by the beginning of January 1998. However in other countries the yield of tar in cigarette smoke is at 22 mg (Mitacek, E. J., Brun neman, K. D., Pollednak, A. P., Hoffman, D., and Suttajit, M., Prev. Med. 20: 764–773, 1991). The changes made in the manufacturing of cigarettes led to the specific removal of certain toxic substances from the cigarette smoke; more specifically the cellulose acetate filters were introduced thus allowing for the partial removal of the semivolatile phenols and the volatile N-nitrosamines (Brunnemann, K. D., Hoffman, d., Recent. Adv. Tobacco Res. 17: 71–112, 1989). Carbon monoxide is selectively reduced with the use of perforated filters. The concentration of carcinogenic polynuclear aromatic hydrocarbons (PAH) was selectively reduced with the use of tobacco enriched with nitrite. However the reduction of PAH in tobacco using high concentrations of nitrite led to undesirable increases of carcinogenic N-nitrosamines, it was thus necessary to reduce the PAH by alternate means (Hoffman, D., Hoffman, I., Wynder, E.1., Lung Cancer and the Changing Cigarette in Relevance to Human Cancer of N-Nitroso-compounds, Tobacco Smoke and Mycotoxins. (eds. O'Neil, I. K., Chen, J., and Bartsch, H.) Vol. 105: 449–459, 1991).

From the above mentioned it becomes clear that there is a necessity to manufacture a filter capable of withholding the noxious nitrogen oxides, the free radicals, the hydrogen peroxide, the aldehydes, and the carcinogenic nitrosocompounds which are all responsible for the damaging effects of cigarette smoke on the respiratory and cardiovascular systems. For the identification of the noxious compounds contained in the cigarette smoke we have conducted chemical, biological experiments. The chemical experiments performed are the following:

a) Identification and quantitative determination of NO and NOx using a novel chemical and biological method (this method was developed in our lab).

b) Identification of the free radicals using the lucigenine-dependent chemiluminescence methods.

c) Identification of the aldehydes and quinone through stimulation of the enzymatic system luciferine-luciferase (this method was also developed in our lab).

d) Identification and quantitative determination of the trace elements using the method of the oxidation of luciferine by luciferase in the presence of ATP (this method was developed in our lab).

e) Identification and quantitative determination of $H_2O_2$ using the isoluminolmicroperoxidase dependent chemiluminescence method.

f) Identification and quantitative determination of $ONOO^-$ spectrophotometrically and by luminol enhanced chemiluminescence method.

g) Identification of the carcinogenic nitroso compound by luminol enhanced chemiluminescence.

The Biological experiments performed are the following:

a) Identification of NO by using isolated soluble guanylate cyclase activity as functional parameter.

b) Identification of $ONOO^-$ by using the estimation of the oxidative stress of the human erythrocytes induced by $ONCO^-$.

c) Identification of CO by using isolated soluble guanylate cyclase activity as functional parameter.

Furthermore we performed the following in vitro experiments:

a) Isolation of alveolar macrophages from rat lung.

b) Estimation of the oxidative stress of alveolar macrophages induced by tert-butylhydroperoxide (t-BHP).

c) Determination of $NO/NO_2^-/ONOO^-$ produced by alveolar macrophages.

d) Determination of $H_2O_2$ produced by alveolar macrophages.

e) Effect of exogenous $H_2O_2$ on NO production by alveolar macrophages.

Experiments in vivo in human volunteers were performed for the determination of the following compounds:

a) Determination of NO in the exhaled air of non-smokers.

b) Determination of NO in the exhaled air of smokers.

c) Determination of NO in the exhaled cigarette smoke.

d) Determination of $ONOO^-$ in the exhaled cigarette smoke.

e) Determination of free radicals in the exhaled cigarette smoke.

f) Determination of aldehydes in the exhaled cigarette smoke.

For the determination of NO, NOx contained a) in cigarette smoke, b) released by alveolar macrophages after challenging with cigarette smoke and c) in the exhaled cigarette smoke of human volunteers we designed and fabricated a chamber from 2.5 cm diameter, solid rods of clear Plexiglas which were hollowed out from one end with a machine-lathe to create an identical conical cavity within each of the Plexiglas rods. They were then further machined and polished at the open ends, to form a mated beveled union, creating a very tight fit between the two conical cavities. A thin square of teflon sheet (polytetrafluorethylene 0.0015 inches in thickness) was sandwiched between the assemblies which were recompressed with the thumbscrews. The two tube-access-parts at either side of the membrane, allows biologically active samples and reactive substances to be injected into, withdrawn from or modified at either side of the membrane during biological reactions (FIG. 1).

A. Determination of NO by Chemiluminescence

The standard NO solution was prepared according to the literature (Deliconstantinos, G., Villiotou, V., Fassitsas, C., (1992) J. Cardiovasc. Pharmacol. 12, S63–S65) and (Deliconstantinos, G., Villictou, V., Stavrides, J. C., (1994) In: "Biology of Nitric Oxide", eds. Feelish, M., Busse, R., Moncanda, S., Portland Press, in press). The reaction solution consisted of Hank's Balanced Salt Solution (HBSS) pH 7.4; H2O2 (500 $\mu$M); luminol (30 $\mu$M) and the total volume was 500 $\mu$l. The vial was vigorously stirred and the emission was recorded in Bedrthold AutoLumat LB953 luminometer.

B. Chemical Determination of $NO/NO_2^-$

The chemical determination of NO was based on the diazotization of sulfanolamide by NO at acidic pH and subsequent oxidation of scopoletin which can be detected fluorometrically as previously described (Deliconstantinos G., Villiotou, V., Fassitsas, C., J. Cardiovasc. Pharmacol 12: S63–S65, 1992). Alveolar macrophages in HBSS ($10^6$ cells/ml) were mixed with 100 $\mu$l of a reagent consisting of: 20% sulfanilamide in 20% $H_3PO_4$ and 25 $\mu$M scopoletin. The decay of the fluorescence was monitored at room temperature (22° C.) with an Aminco SPF-500 Fluorescence Spectrophotometer. The fluorescence was monitored continuously in time until the slope of the line could be measured (approx. 8 min). Slope measurements were then converted to nmols of NO using a standard curve constructed with various concentrations of pure NO. Nitrite ($NO_2^-$) the end product of NO synthesis was measured on the basis of their accumulation in the supernatants of cells cultured by its reaction with Griess reagent.

C. Spectroscopical Determination of Peroxynitrite ($ONOO^-$)

$ONOO^-$ was synthesized, titrated, and stored as previously described (Deliconstantinos, G., Villiotou, V., Stavrides, J. C., In: "Biology of nitric oxide" (eds. Feelisch, M., Busse, R., and Moncada, S.) Portland Press (in press). Because of the instability of $ONOO^-$ at pH 7.4, UV spectra were recorded immediately after mixing the $H_2O_2$ and NO solution. The concentration of $ONOO^-$ was determinated based on an $\epsilon$302 nm value of 1670 $M^{-1}$ $cm^{-1}$. UV spectra were shown after subtraction of the basal UV spectra of $H_2O_2$ at corresponding concentrations.

D. Estimation of free radicals

The estimation of free radicals was performed by using the lucigenin/DAMCO (1,4 diazabicyclo-[2,2,2]octane)-induced chemiluminescence as previous described (Deliconstantinos, G., Krueger, G. R. F., J. Viral Dis. 1: 22–27, 1993). The reaction mixture consisted of HBSS pH 7.4; lucigenin (30 $\mu$M); DAMCO (100 $\mu$M). The vial was vigorously stirred and the emission was recorded in a Bedthold AutoLumat LB953 luminometer. Scavengers of oxygen free radicals were used (SOD, mannitol, histidine, methionine).

E. Estimation of trace elements and aldehydes

The assays were based on the luciferase-catalyzed oxidation of D-luciferin in the presence of an ATP-magnesium salt according to the reaction:

$$LH_2 + ATPMg^{2+} + O_2 \xrightarrow{\text{luciferase}} \text{Oxyluciferin} + ATP + O_2 + PPi + Mg^{2+} + \text{light}$$

The trace elements $Cd^{2+}$, $Cu^{2+}$, $Fe^{2+}$ increase the luciferase activity and the maximum chemiluminescence response is proportionally increased according to the concentrations of the trace elements up to 10 $\mu$g. The reactions take place in HBSS pH 7.4 in total volume of 0.5 ml.

For the estimation of the aldehydes the same enzymatic system luciferin/luciferase was used but in the absence of ATP. Aldehydes reacts with the enzymatic system to produce chemiluninescence without the presence of ATP. The reagents used were taken from an ATP assay Kit (Calbiochem-Novabiochem Calif., U.S.A.).

F. Isolation of alveolar macrophages

In brief, rats were killed with an intravenous injection of sodium pentobarbital, the thorax was opened, the lungs were perfused free of blood with $Ca^{2+}$ free cold (4° C.) phosphate buffered saline (PBS; pH 7.4), and removed intact from the chest cavity. The homogenate of rat lung was obtained by repeatedly drawing the tissue through a syringe and then passing it through successively finer stainless steel screens ranging from 32, 62 and 68 pores per inch., meshes respectively, and under a constant stream of Finkelstein Balanced Salt Solution (FBSS; pH 7.4). The final suspension of alveolar macrophages were pooled, filtered and centrifuged at 300×g for 10 min to pellet the cells. The cell pellet, consisting of more than 98% macrophage, was washed and resuspended in Ringer's solution. Then the procedure was repeated two times. Approximately $10\times10^8$ macrophages were isolated per rat. Viability was assessed by trypan blue exclusion.

F. Identification of nitrosocompounds

Nitrosocompounds were identified by the slow release of nitric oxide (NO) after their treatment with $H_2O_2$. The reaction solution consisted of dimethyl nitrosamine and/or diethyl nitrosamine (1 $\mu$M); $H_2O_2$ (500 $\mu$M); luminol (30 $\mu$M) in HBSS pH 7.4 total volume 0.5 ml. The vial was vigorously stirred and the emission was recorded in a Bedrthold AutoLumat LB953 luminometer. Mannitol (100 mM); DMSO (100 mM) and cysteine (3.0 mM) were used to identifine the formation of $ONOO^-$.

G. Isolation of alveolar macrophages

In brief, rats were killed with an intravenous injection of sodium pentobarbital, the thorax was opened, the lungs were perfused free of blood with $Ca^{2+}$ free cold (4° C.) phosphate buffered saline (PBS; pH 7.4), and removed intact from the chest cavity. The homogenate of rat lung was obtained by repeatedly drawing the tissue through a syringe and then passing it through successively finer stainless steel screens ranging from 32, 62 and 68 pores per inch., meshes respectively, and under a constant stream of Finkelstein Balanced Salt Solution (FBSS; pH 7.4). The final suspension of alveolar macrophages were pooled, filtered and centrifuged at 300×g for 10 min to pellet the cells. The cell pellet, consisting of more than 98% macrophage, was washed and resuspended in Ringers solution. Then the procedure was repeated two times. Approximately $10\times10^8$ macrophages were isolated per rat. Viability was assessed by trypan blue exclusion.

H. Oxidative stress of alveolar macrophages induced by t-butyl -hydroperoxide (t-BHP)

The generation of oxygen free radicals by alveolar macrophages induced by t-BHP (2.5 mM) was determined by using a luminol chemiluminescence method. The chemiluminescence response was recorded in a Bedrthord AutoLumat LB953 luminometer as previous described (Deliconstantinos, G., Krueger, G. R. F., J. Viral Dis. 1, 22–27 1993).

I. Determination of hydrogen peroxide ($H_2O_2$)

An isoluminol/microperoxidase cocktail (100 mM sodium borate, 1 mM isoluminol, 0.01 mM microperoxidase in 70% water and 30% methanol at pH 8) was prepared. 50 $\mu$l of this regent were mixed with the isolated alveolar macrophages ($10^6$ cells) in HBSS in a total volume of 0.5 ml. The chemiluminscence response was converted to nmols of $H_2O_2$ using a standard curve constructed with various concentrations of pure $H_2O_2$. J. Preparation and Purification of soluble Guanylate cyclase (sGC) for CO estimation. sGC from human endothelial cells was purified by GTP- agarose chromatography. Cytosols (10 mg protein) were added to a GTP- agarose column (1.8×9 cm) pre equilibrated with 25 mM Tris-HCl buffer pH 7.6 containing 250 mM sucrose and 10 mM $MnCl_2$. sGC was then eluted from the column with 5 ml equilibration buffer plus 10 mM GTP.

K Determination of Cyclic GMP

Concentrations of cGMP were determined by radioimmunoassay after acetylation of the samples with acetic anydride (Delikonstantinos, G., and Kopeikina, L., Anticancer Res. 9: 753–760, 1989). The reaction mixture contained trnethanolamine/HCl (50 mM); creatine phosphate (5 mM); $MgCl_2$ (3 mM); isobutylmethylxanthine (1 mM); creatine kinase (0.6 Units); GTP (1 mM); soluble guanylate cyclase (1 $\mu$g protein) in a total volume of 150 $\mu$l. The reactions were initiated by the addition of GTP and incubated for 10 min at 37° C. The incubation medium was aspirated and cGMP was extracted by the addition of ice-cold HCl (0.1M). After 10 min, the samples were transferred to a new plate dried, and reconstituted in 5 mM sodium acetate (pH 4.75) for cGMP determination. cGMP formed was determined using a cGMP assay kit (Amersham).

DESCRIPTION OF THE INVENTION

The target of the present invention is to create and apply the methods in which biological substances are used that react specifically and scavenge the following:

a) NO and NOx,
b) CO,
c) $H_2O_2$,
d) Free radicals,
e) Aldehyde- quinones,
f) Carcinogenic nitrosocompounds,
g) Withholding the trace elements cadmium, copper, manganese, iron etc. which are inhaled during smoking.

This invention relies heavily on the notion that:

a) There is selection of appropriate scavengers, like hemoglobin or lysates of erythrocytes or any substance which contains stereospecifically bound iron
b) There is selection of scavengers which contain porphyrin ring with iron (e.g. protoporphyrin)
c) There is selection of scavengers which contain porphyrin ring that does not necessarily contain iron
d) There is selection of scavengers which contain porphyrin ring complexed with other metals, e.g. $Mg^{2+}$, $Cu^{2+}$
e) A biotechnical process will be designed for the enrichment of common conventional materials which are presently used in the production of cigarette filters which will contain the above mentioned biological substances-scavengers.

The pivotal idea in this invention lies in the concept that impregnation of common conventional cigarette filters and/or filters containing activated charcoal can be enriched with the biological substances, characterized by the presence of metal ions $Fe^{2+}$, $Cu^{2+}$, $Mg^{2+}$ complexed with the porphyrin ring, as well as $Fe^{2+}$ bound stereospecifically to protein molecules, thus allowing the noxious compounds contained in the cigarette to be withheld before the smoker inhales the cigarette smoke. This fact is the main characteristic of the present invention and consists of an undeniable innovation with great feasible industrial applications.

METHODS FOR INDUSTRIAL APPLICATION

Figure 2:
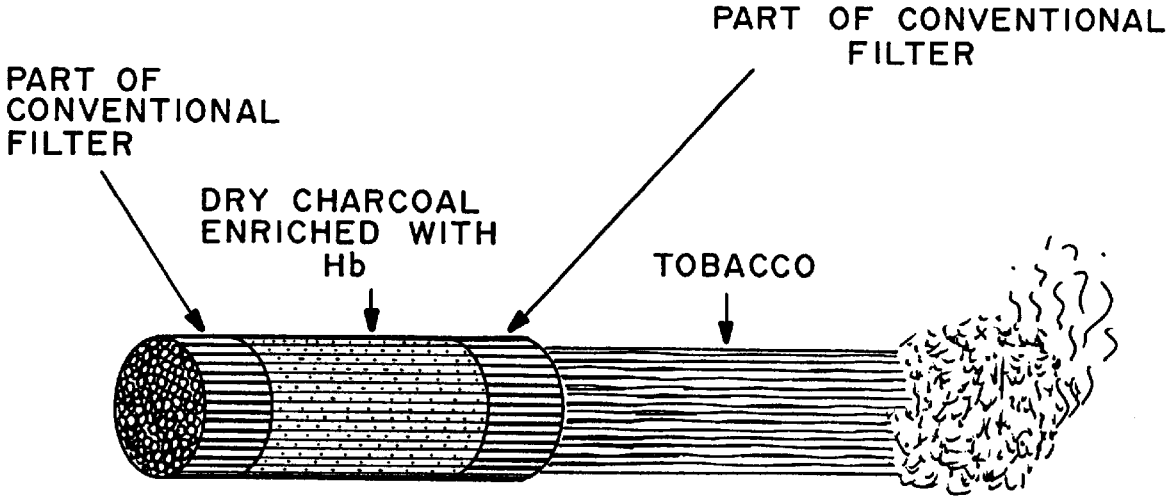

This invention was prepared in the following way in light of its applicability to industrial production levels:

A solution of 1 mg/ml of hemoglobin and/or lysate of erythrocytes in phosphate buffered saline solution (PBS) with a pH of 7.4 was prepared and added to 100 mg of activated charcoal. They were incubated for 30 min at room temperature and filtered through a S&S Carl Schleicher & Schuell Co U.S.A. filter paper. The quantity of the non-absorbed hemoglobin was estimated in the filtrate spectrophotometricaly. The charcoal enriched with hemoglobin was left to dry at room temperature. A quantity of 200 mg of dry charcoal enriched with hemoglobin was sandwiched between two common filters so that all cigarette smoke drawn through comes into contact with the active. groups of the molecules ($Fe^{2+}$, $Fe^{3+}$, —SH, —$NH_2$) (FIG. 2). These compatible materials are now ready to be used for the manufacturing of the new cigarette filters which we will refer to from now on as biological filters.

Alternatively hemoglobin can be replaced by biological substances characterized by the presence of metal ions $Fe^{2+}$, $Cu^{2+}$, $Mg^{2+}$ complexed with the porphyrin ring, as well as $Fe^{2+}$ bound stereospecifically to protein molecules, such as transferin, catalase, protoporphyrine, cytochrome C, chlorophyll.

Alternatively, a solution of 5 mg/ml of hemoglobin and/or lysate of erythrocytes in phosphate buffered saline solution (PBS) with a pH of 7.4 was prepared and scanned at 25° C. using an Acta Beckman recording spectrophotometer. An absorbance peak was consistently observed at 540 nm and 575 nm (Smith, R. P., Kruszyma, H. J. Pharmacol. Exper. Ther. 191, 557–563, 1974). Common conventional cigarette filters were impregnated with these solutions and they were air dried at 25–35° C. These compatible materials are now ready to be used for the manufacturing of the new cigarette filters which we will refer to from now on as biological filters. These new biological filters ensure that the smoke which is inhaled comes completely into contact with the active groups of the hemoglobin molecules and/or lysates of the filter without changing the physical properties or the taste of the cigarette smoke. For aesthetic reasons a small part (3 mm) of a conventional filter can be adapted to the visible end of the biological filter.

Alternative industrial production methods include the following.

A solution of 5 mg/ml of protoporphyrin in buffer solution (PBS) pH 7.4 was prepared, and scanned at 25° C. using an Acta Beckman recording spectrophotometer. Excitation of protoporphyrin with ultra violet light (498–408) produced an orange-red fluorescence between 620–630 nm. The conventional filters were then impregnated (soaked) with the above solution and dried with hot air (25–35° C.).

Alternatively a 5 mg/ml solution of transferine in PBS pH 7.4 is scanned using the Acta Beckman recording spectrophotometer. The ferric-transferine shows a characteristic spectrum of 470 nm. The above methods for impregnating the currently used conventional filters was used.

Alternatively a 5 mg/ml solution of catalyse in PBS pH 7.4 is prepared.

The above method for the preparation of the biological filter is to be followed.

Alternatively a 5 mg/ml solution of cytochrome C in PBS pH 7.4 is prepared. The above method for the preparation of the biological filter is to be followed.

Alternatively a 5 mg/ml of chlorophyll in PBS pH 7.4 is prepared. The above method for the preparation of the biological filter is to be used.

Alternatively the above mentioned biological substances are sandwiched between two common filters in solid form so that all cigarette smoke drawn through the filter comes into contact with the active groups of the molecules ($Fe^{2+}$, $Fe^{3+}$, —SH, —$NH_2$).

ANALYSIS OF THE RESULTS

The various biological substances used to enrich the conventional filters have been shown to retain the toxic compounds (NO, CO, free radicals, $H_2O_2$, aldehydes and trace elements and nitrosocompounds) from cigarette smoke in varying degrees as can be seen in the table below:

| scavengers | NO % | CO % | Free radicals % | $H_2O_2$ % | Aldehydes % | Nitroso-compounds % | Trace elements % |
|---|---|---|---|---|---|---|---|
| Hemoglobin | 90 | 90 | 90 | 80 | 90 | 90 | 95 |
| Transferin | 85 | 90 | 60 | 60 | 60 | 75 | 50 |
| Catalase | 85 | 90 | 90 | 90 | 80 | 80 | 80 |
| Protoporphirin | 85 | 90 | 70 | 80 | 70 | 75 | 80 |
| Cytochrome C | 85 | 80 | 70 | 80 | 60 | 60 | 70 |
| Chlorophyll | 15 | 10 | 40 | 15 | 10 | 10 | 80 |

The degree of retention of the highly damaging substances of the cigarette smoke was obtained, and the smoke of the cigarette (20 ml) filtered through a biological filter was compared with that filtered through a conventional filter (20 ml). Only 1 ml cigarette smoke drawn through the conventional filter was compared with 40 ml of cigarette smoke drawn through a biological filter. It appears that the biological filters have 40 times the capability of retaining the trace elements as compared to conventional filters.

Figure 3:
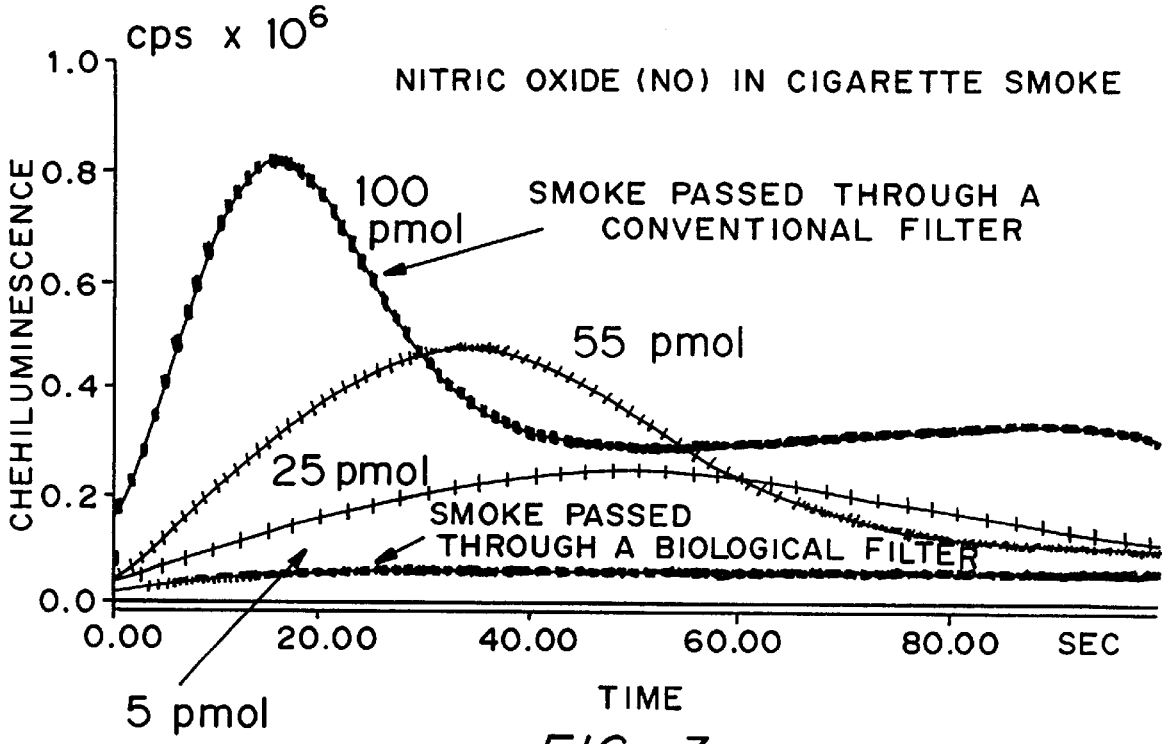
Figure 4:
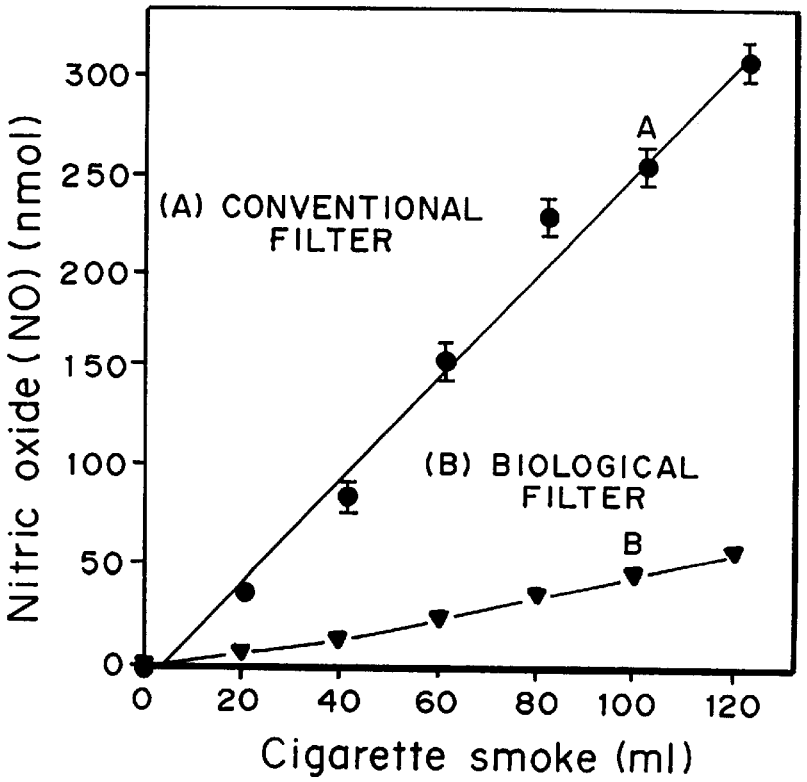
Figure 5:
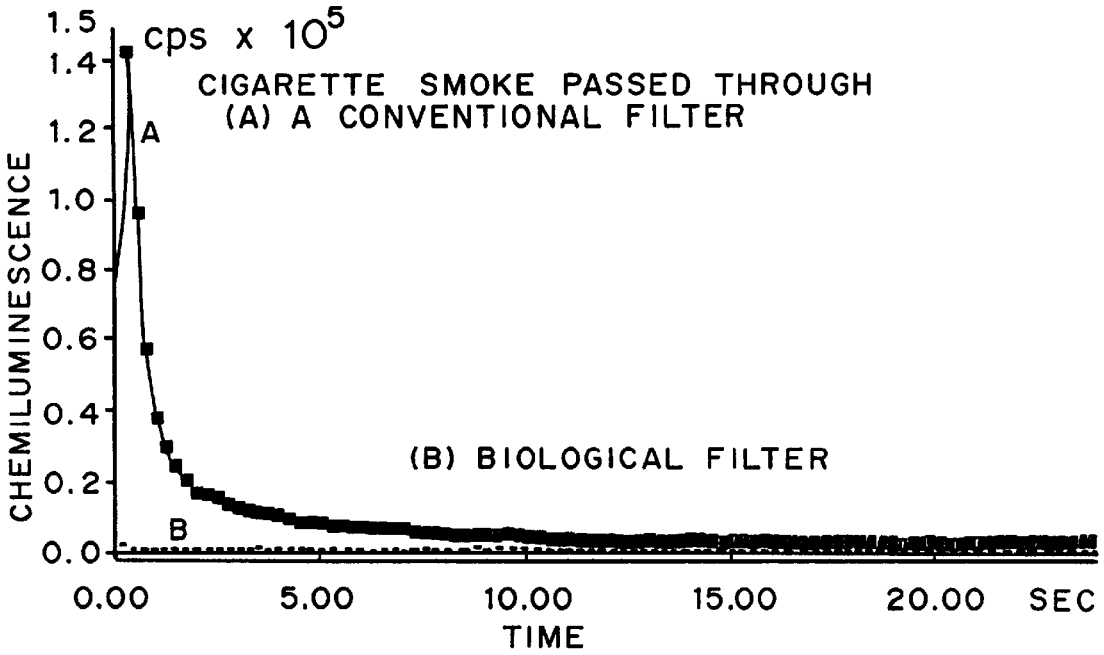
Figure 6:
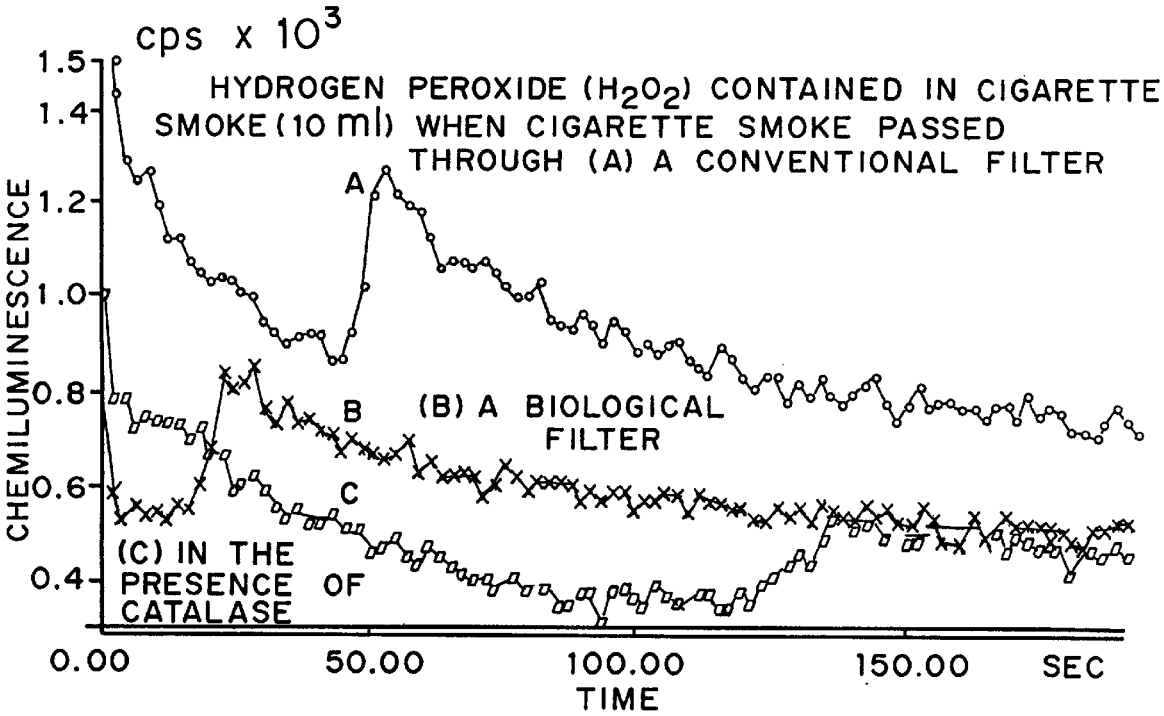

In the following detailed experimental description representative results are shown so as to better comprehend the activity of these biological substances.

a) Identification of NO contained in cigarette smoke using the chemiluminescence method:

NO was identified using the luminol enhanced chemiluminescence method as described in the experimental section. FIGS. 3 and 4 illustrate a typical experiment of NO identification and estimation, as well as its scavenging after the passage of cigarette smoke through the biological filter. It appears that more than 90% of the NO is retained by the hemoglobin. The effectiveness of the biological filter is apparent in retaining and neutralizing the NO which has been implicated in toxic reactions both in lung cells and in lung fluids especially when it is involved in the formation of the strong oxidant ONOO— b) Identification of free radicals contained in cigarette smoke using the chemiluminescence method:

The free radicals in cigarette smoke were identified by the chemiluminescence response caused by the system lucigenine/DAMCO after its reaction with the free radicals. FIG. 5 shows a characteristic peak taken within 2 seconds of the chemiluninescence response which was inhibited 100% after the passage of the cigarette smoke through a biological filter. The retention of the free radicals by the biological filters implies that there will be reduction of oxidative stress in the alveolar macrophages which is caused by conventional cigarette smoke.

c) Identification of $H_2O_2$ contained in cigarette smoke using the chemiluminescence method:

$H_2O_2$ was estimated by the chemiluminescence response produced by the system isoluminol/microperoxidase. FIG. 6 shows the characteristic peak of cheniluminescence due to the presence of $H_2O_2$ in cigarette smoke. In the presence of catalase (100 units/ml) the chemiluminescence response was inhibited approximately 90%. When the cigarette smoke passed through a biological filter an 80% inhibition of the chemiluminescence response was observed. The isoluminol/microperoxidase system is specific for the identification of $H_2O_2$. The free radicals contained in cigarette smoke evoke a minute chemiluminescence response after their interaction with isoluminol. This minute chemiluminescence appears to be approximately 10% of the total chemiluminescence caused by $H_2O_2$ in the presence of free radicals since catalase inhibits the maximum chemiluminesent response up to 90%. The retention of $H_2O_2$ apparently reduces both the oxidative stress and the production of NO by the alveolar macrophages.

d) Identification of trace elements and aldeydes contained in cigarette smoke using the enzymatic system luciferine/luciferase.

Figure 7:
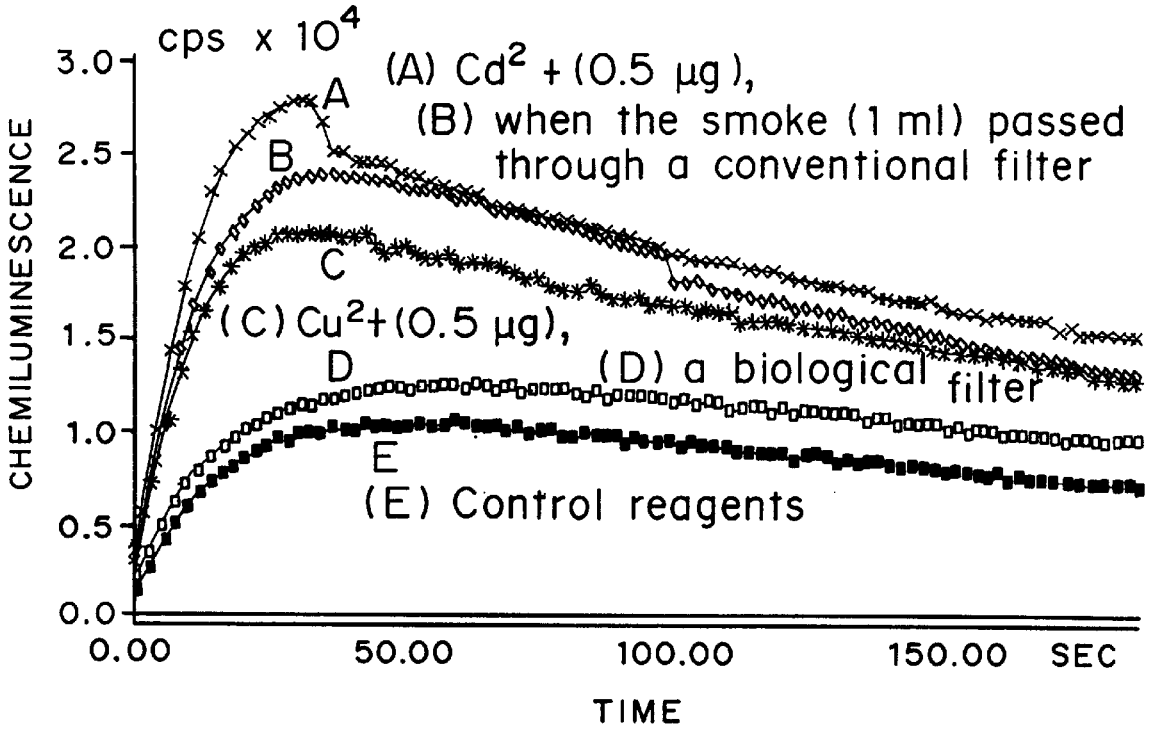

Trace elements contained in the cigarette smoke were identified by their capacity to stimulate the luciferase activity. FIG. 7 depicts:

1) the chemiluminescence response caused by the oxidation of luciferine in the presence of ATP,
2) the enhanced chemiluminescence response in the presence of $Cd^2$+ions (0.5 mg),
3) the enhanced chemiluminescence response in the presence of $Cu^2$+ions (0.5 mg),
4) the enhanced chemiluminescence response caused by cigarette smoke (1 ml) and
5) the inhibition of chemiluminescence response (with respect to that caused by the cigerette smoke) caused by 40 ml cigarette smoke when passed through the biological cigarette filter. It is obvious that the chemiluminescence response caused by trace elements contained in conventional cigarette smoke are more than 40 times higher than those passed through a biological filter. The withholding of trace elements by the biological filters may have both short term and long term effects. Short term effects could entail the inhibition of redox reactions from taking place in the lung (Fe, Mn) and long term effects could entail inhibition of damages to the constituents and substances in the blood(Cd).

Figure 8:
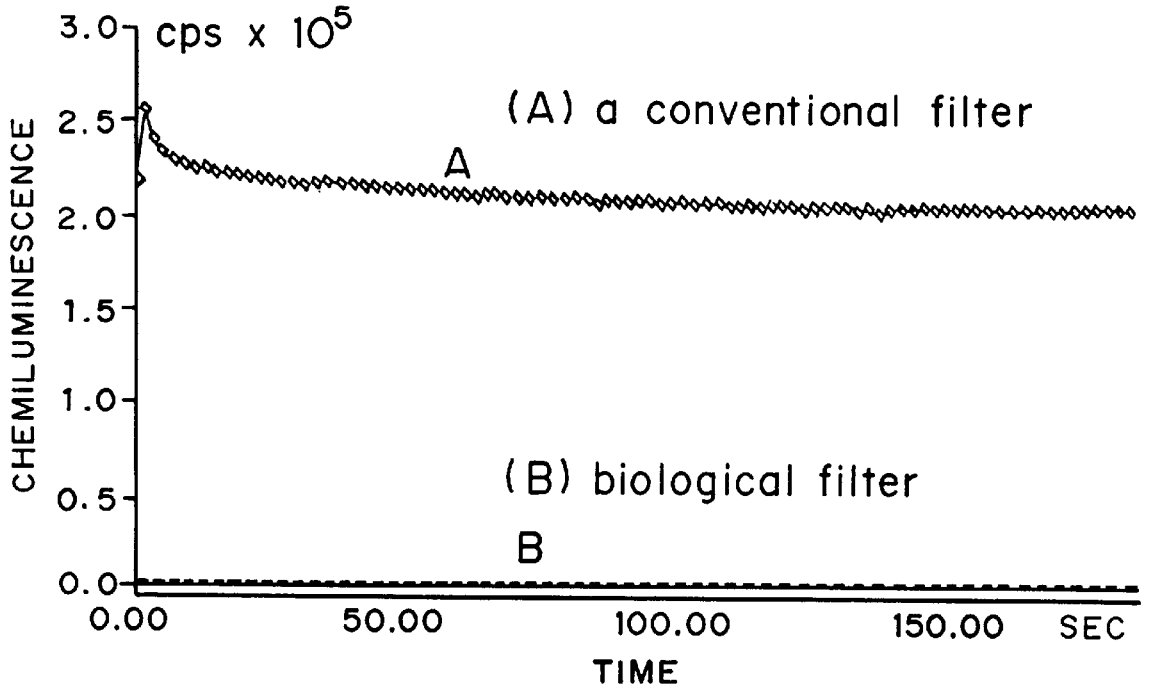

The aldehydes contained in cigarette smoke were identified and estimated using the same enzymatic system luciferine/luciferase in the absence of ATP. Aldeydes are capable of causing oxidation of luciferine. FIG. 8 shows a characteristic chemiluminescence response which could last for more than an hour. This chemiluminescence response was inhibited 100% when the cigarette smoke used had been passed through the biological filter, suggesting that the effectiveness of the biological filter to withhold the toxic aldehydes is substantial.

e) Identification of nitrosocompounds in cigarette smoke.

Figure 9:
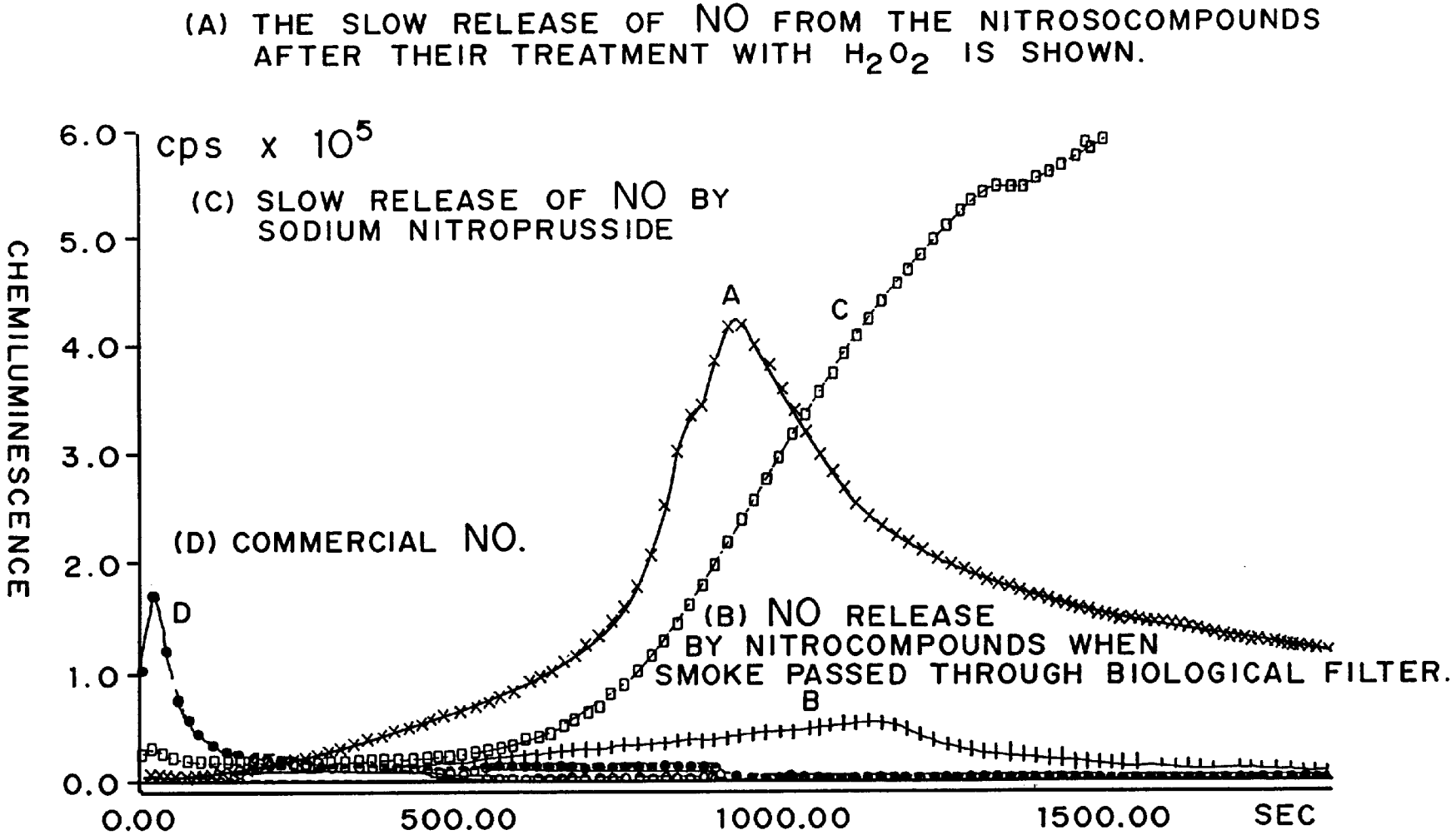
Figures 10A, 10B, 10C:
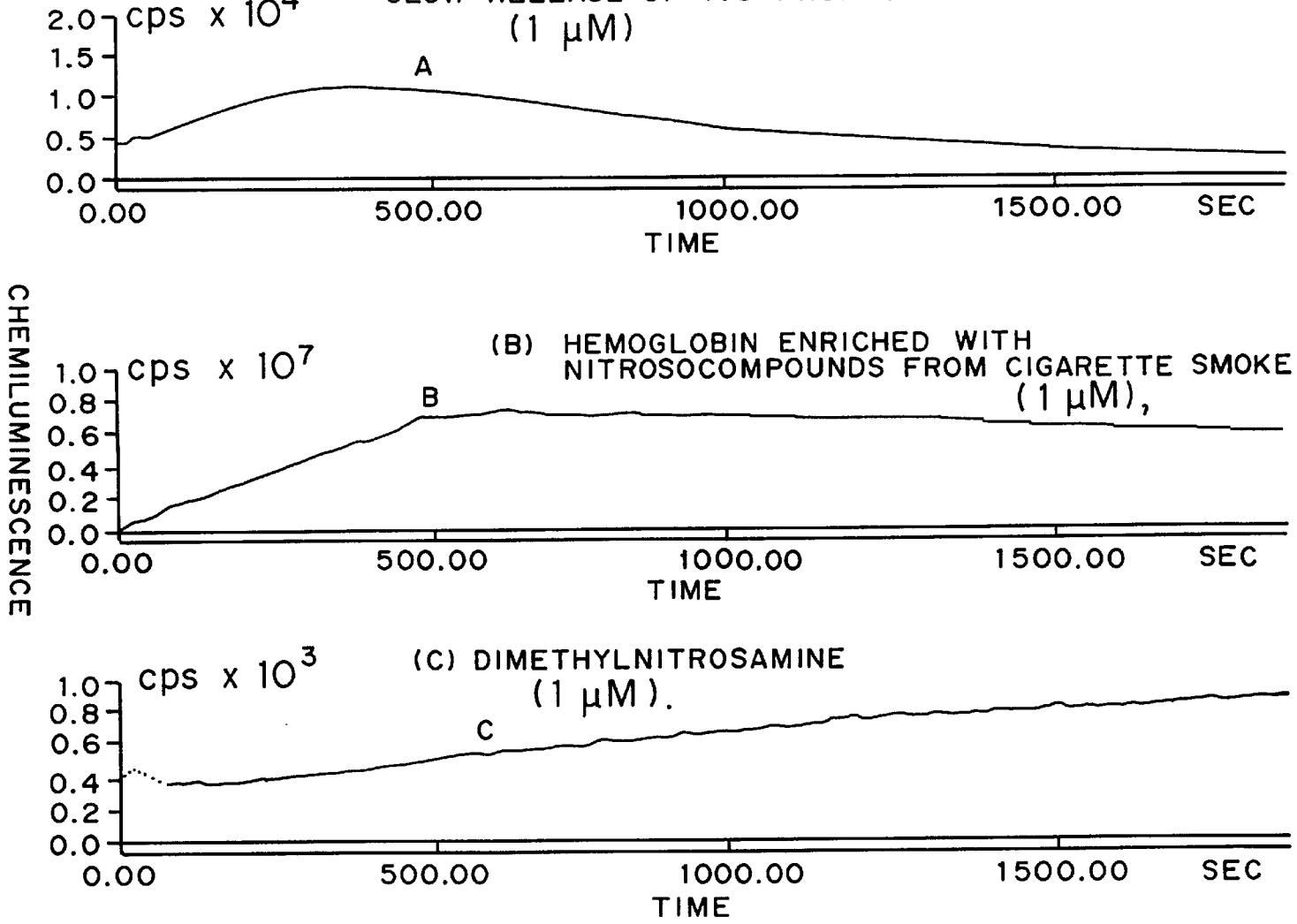
Figure 11:
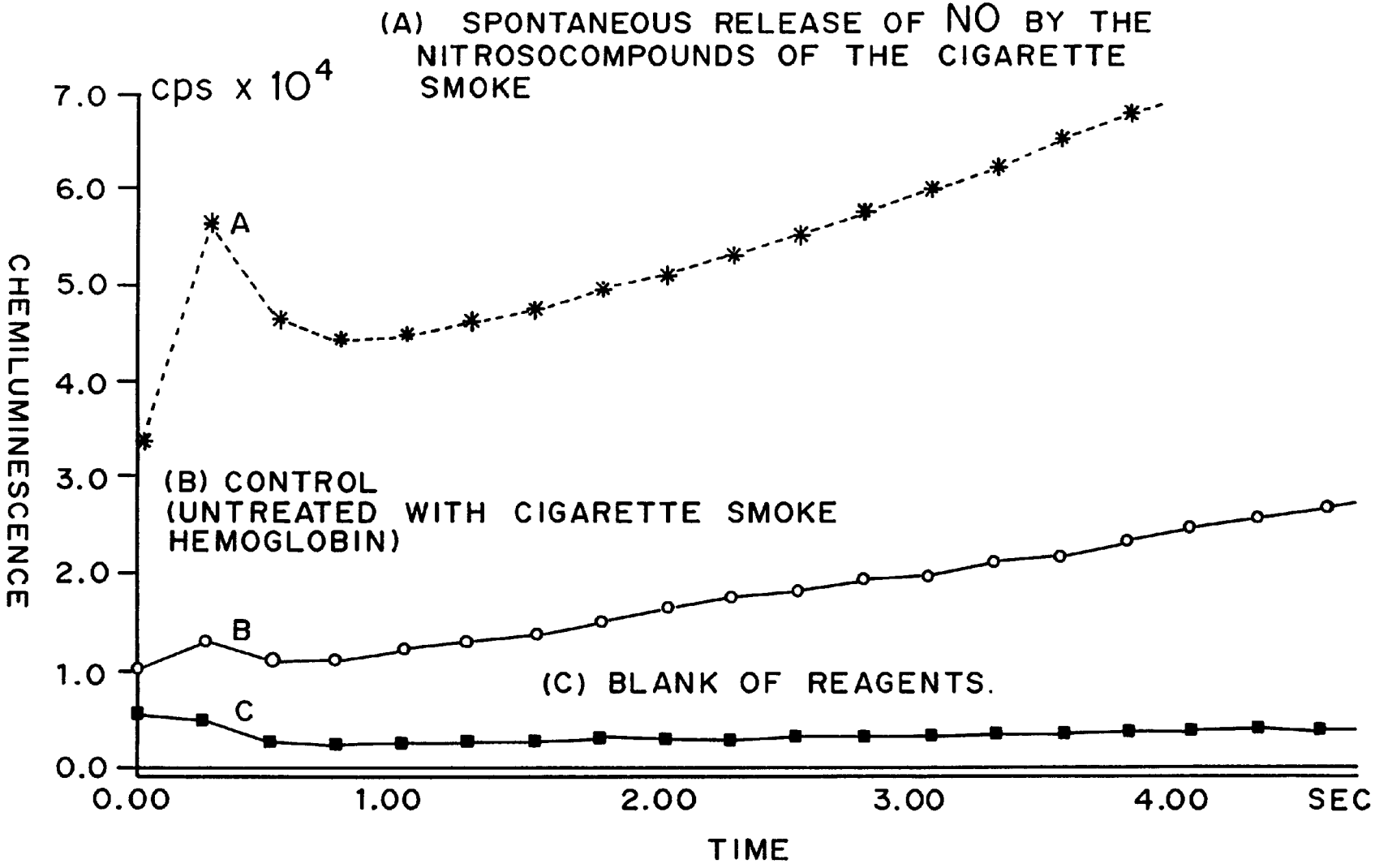
Figure 12A:
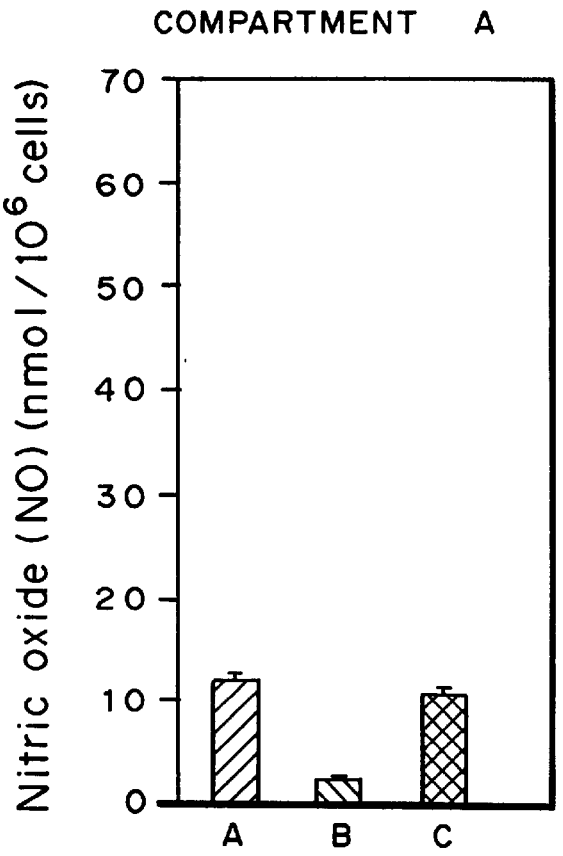
Figure 12B:
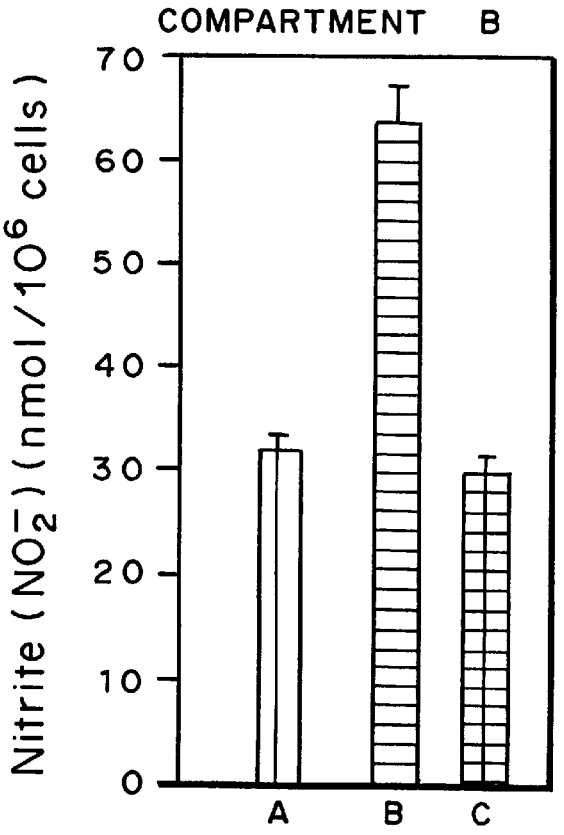

The identification of nitrosocompounds contained in cigarette smoke was obtained by estimating the slow release of NO from nitrosocompounds after their treatment with $H_2O_2$. As shown in FIG. 9 a peak chemiluminescence response was obtained at approximately 900 seconds. Passage of the cigarette smoke through a biological filter showed a 90% inhibition in the chemiluminescence response observed and its peak was taken at approximately 1200 seconds. The slow release of NO by sodium nitroprusside (SNP) after its treatment with $H_2O_2$ is also shown. FIG. 10 shows the slow release of NO from both: the nitrosocompounds diethyl nitrosamine and dimethyl nitrosamine; and from hemoglobin enriched with nitrosocompounds from cigarette smoke treated with $H_2O_2$. It is clear that the NO release by the nitrosocompounds of the cigarette smoke, which have formed adducts with hemoglobin, follow the same pattern of NO release as the nitrosocompounds diethylnitrosamine and dimethyl nitrosamine. FIG. 11 shows the release of NO by the nitrosocompounds of the cigarette smoke which have formed adducts with hemoglobin after the hemoglobin-nitrosocompound adducts were irradiated with UVB (100 mJ/$cm^2$) for one minute. The NO release was estimated in the presence of $H_2O_2$ and gave a chemiluminescence response at 1 second. The gradual rise observed in FIG. 11 is due to the effect of $H_2O_2$ on hemoglobin (Fenton reaction).

f) Production of NO by lung macrophages:

In vitro experiments were carried out with the help of a special chamber that was created in our lab, and which is shown in FIG. 1. The teflon membrane, separating the two compartments in the chamber, is permeable to gas NO and impermeable to $NO_2$— and ONOO—. Unchallenged lung macrophages isolated as described in the experimental section were suspended in HBSS buffer solution ($1\times10^6$ cells/ml) and placed in the A compartment of the chamber. In compartment B of the chamber 2.5 ml Griess reagent or sulfanilamide/scopoletin reagent is placed. The NO, released by macrophages in compartment A, diffuses through the teflon membrane into compartment B. and binds with the Griess and/or sulfamide/scopoletin reagents where it remains trapped. This indicates that lung macrophages produce gas NO. The amount of NO now present in compartment B was then determined spectrophotometrically or fluorophotometrically. The quantities of ONOO— and $NO_2$— contained in compartment A of the chamber were also determined using the Griess and/or sulfanilamide/scopoletin reagents. The above experiments were repeated after challenging the macrophages with cigarette smoke before placing them in compartment A. The results, as depicted in FIG. 12, show that cigarette smoke decreases the amount of NO produced whilst increasing production of ONOO— in lung macrophages, indirectly indicating the tremendous production of both NO and $O_2$— which interact to form ONCO—.

Figure 13:
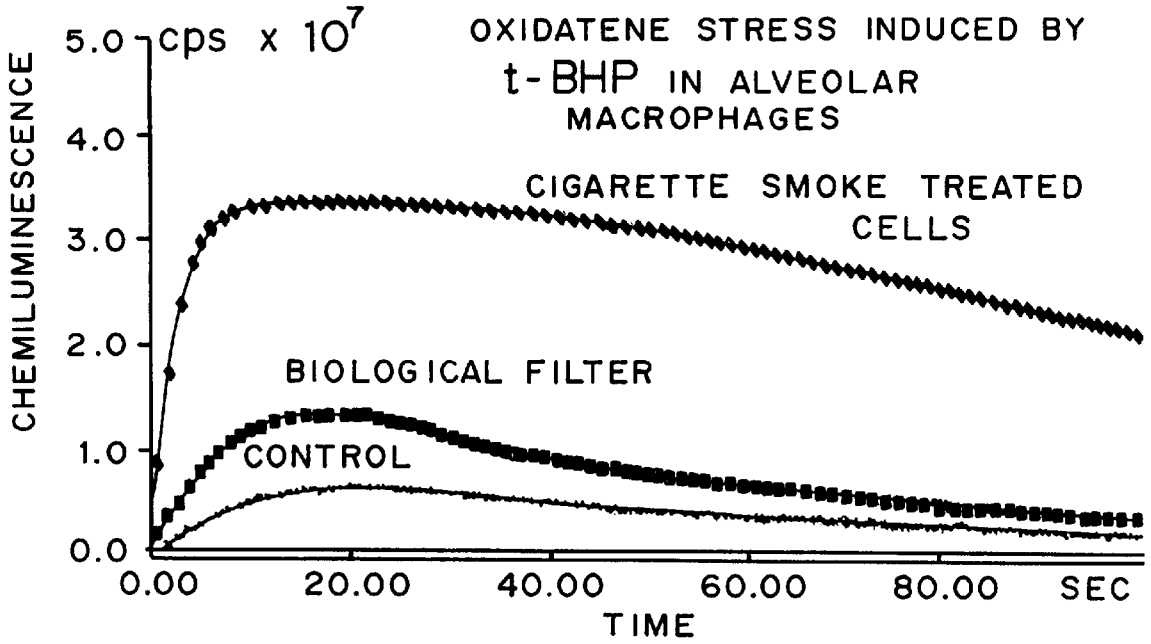
Figure 14:
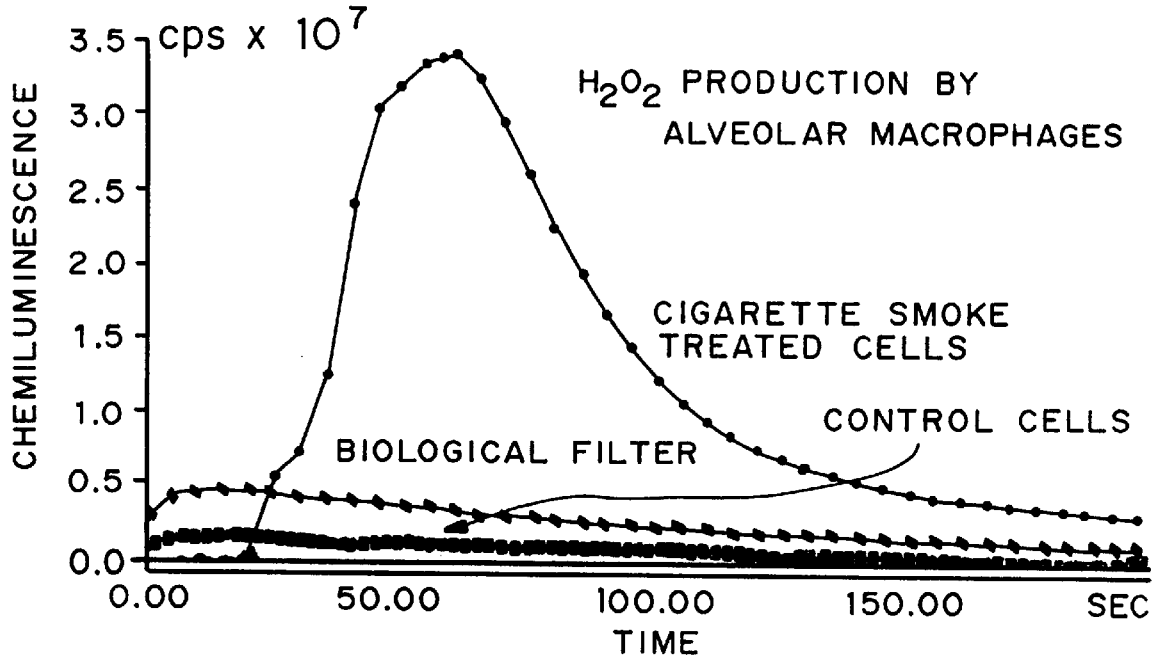
Figure 15A:
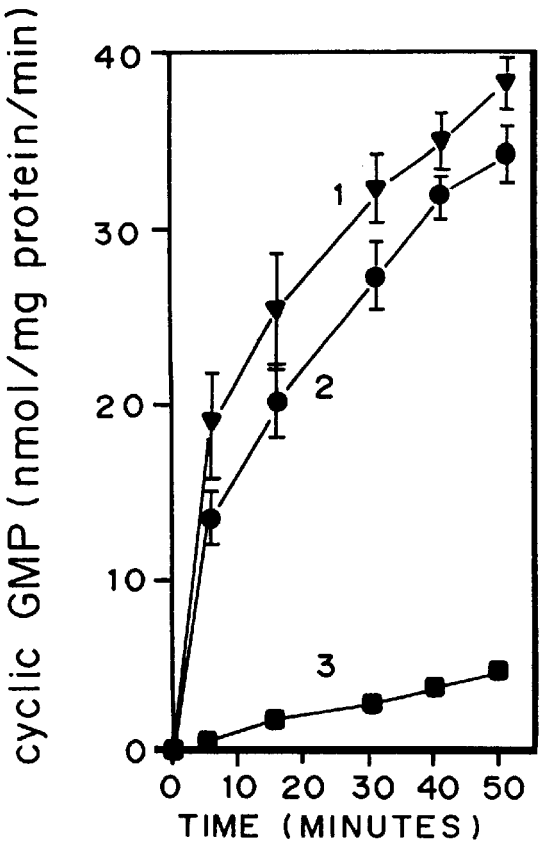
Figure 15B:
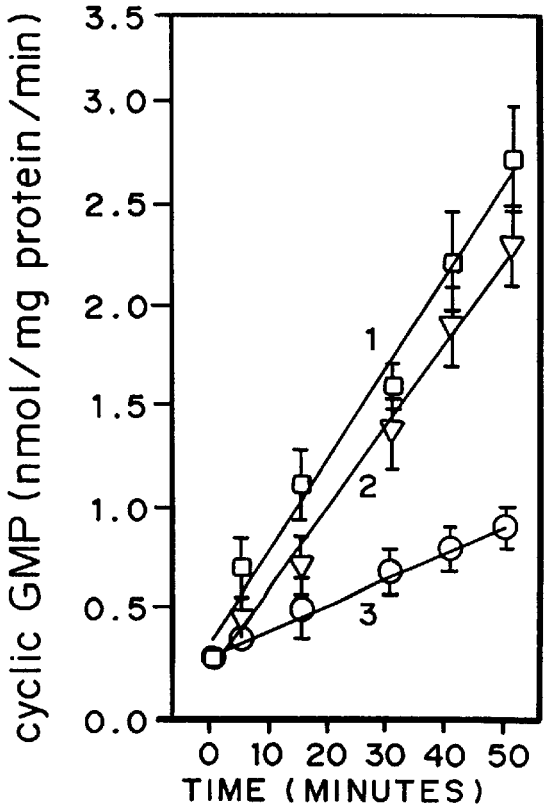
Figure 16:
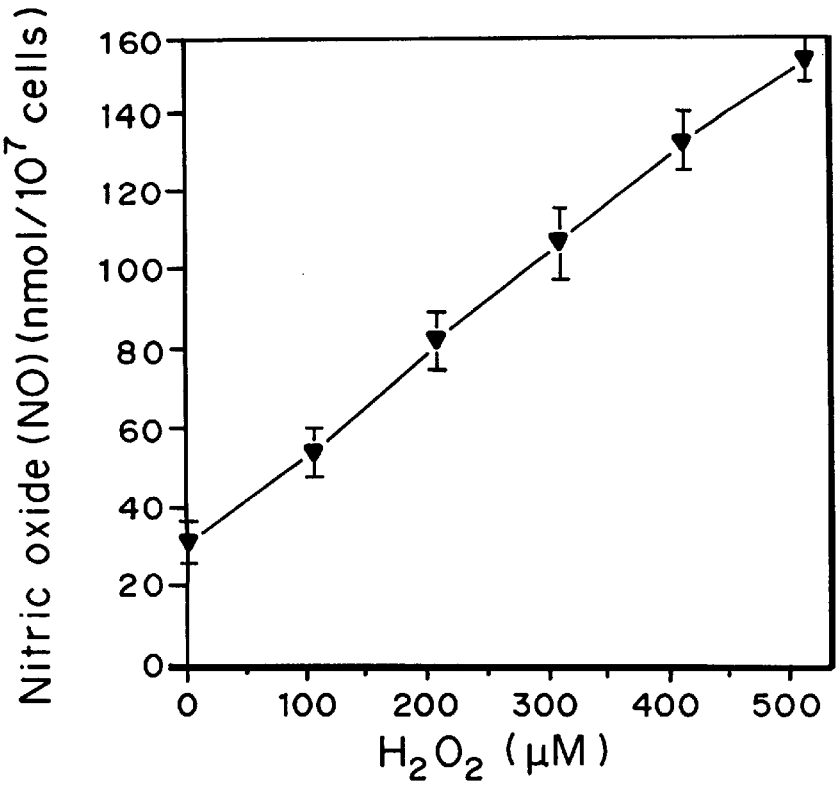

Repetition of the above experiments using biological filters (i.e. in which cigarette smoke was drawn through a biological filter) showed that the biological substances used, produce the same quantities of $NO_2$— and ONOO— in compartment A and similar quantities of NO in compartment B as would macrophages not challenged with cigarette smoke. In this context, the components of the Griess reaction were also used to examine the kinetics of nitrosation by intermediate(s) generated during the NO/$O_2$ reaction in aqueous solution at physiologigal pH. Addition of cigarette smoke (50 ml) to a 100 mM phosphate solution pH 7.4 containing 25 mM sulfanilamine and 2.5 mM N-(1-naphthyl ethylenediamine dihydrochloride (NEDD) generated an absorption at $\lambda$max=496 mm indicative of the characteristic azo product resulting from nitration. It is worthwhile to consider the implications of the present observations vis-a-vis the expected reactivities of NO under physiological relevant conditions, where maximal concentrations of NO in the cellular microenvironment are estimated to be in the range of 0.5–10 $\mu$M. The NO concentrations are dramatically increased during cigarette smoking with detrimental effects on the lung cells.

g) Oxidative stress of lung macrophages:

The results on the effects of cigarette smoke on the oxidative stress of lung macrophages are illustrated in FIG. 13. Estimations of the oxidative stress using t-BHP, showed that cigarette smoke causes twice the oxidative stress that unchallenged macrophages do. When the cigarette smoke was passed through a biological filter the oxidative stress observed was similar to that of unchallenged lung macrophages. It is thus clearly indicated the elimination of the oxidative stress induced by cigarette smoke on macrophages. The cigarette smoke is now free of the substances that cause oxidative stress on lung macrophages.

h) $H_2O_2$ produced by lung macrophages:

$H_2O_2$ produced by macrophages challenged by cigarette smoke show more that 10 times the production rate as those macrophages not challenged. The use of a biological filter show a decrease in $H_2O_2$ production by 90% (FIG. 14) as compared to conventional filters. It is obvious that as cigarette smoke induces oxidative stress in the macrophages it increases the production of toxic $H_2O_2$ by these cells.

i) Reconstitution experiments:

The amount of cyclic GMP produced by the NO released by alveolar macrophages was determined using the chamber shown in FIG. 1 where soluble guanylate cyclase was placed in compartment A and alveolar macrophages were placed in compartment B. The quantities of NO produced by the macrophages were determined over a period of 50 minutes with and without cells challenged with cigarette smoke. Marcrophages challenged by cigarette smoke (10 ml) released approximately ten times less the amount of NO with respect to the untreated cells thus showing 10 times less production of cyclic GMP. The above procedure was repeated using cigarette smoke passed through a biological filter. It was shown a non statistically significant difference with respect to unchallenged macrophages (control) (FIG. 15). The accumulation of NO in compartment B was increased more than 5 times when the alveolar macrophages were treated with $H_2O_2$ (5 mM) FIG. 16. This suggests that $H_2O_2$ increases the production of NO by a positive feedback mechanism. The L-arginine/NO pathway in macrophages is consistent with the concept that cigarette smoke causes the release of NO/ONOO—.

k) Identification of carbon monoxide (CO) in cigarette smoke:

CO presence in cigarette smoke was determined using the biological method based on the stimulation of soluble guanylate cyclase by CO.

Figure 17:
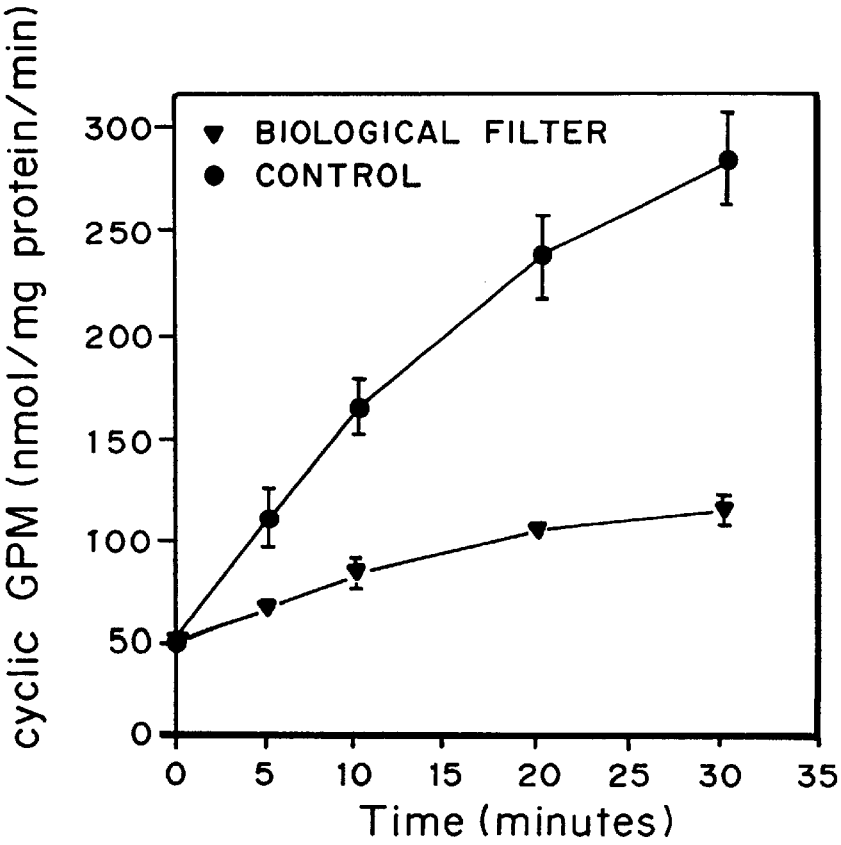

Introduction of HBSS saturated with cigarette smoke into compartment A of the chamber, in the presence of superoxide so as to neutrilize NO, and the introduction of soluble guanylate cyclase into compartment B resulted in an increase in cyclic GMP production due to CO diffusing from compartment A to compartment B. Passage of cigarette smoke through a biological filter reduces the amount of cyclic GMP produced by approximately 80% (FIG. 17). The above data indicates that the noxious substances NOx and CO contained in cigarette smoke are retained and neutralized by the biological filters.

IN VIVO EXPERIMENTS a) We first confirmed the presence of NO and ONCO— in exhaled cigarette smoke.

Figure 18:
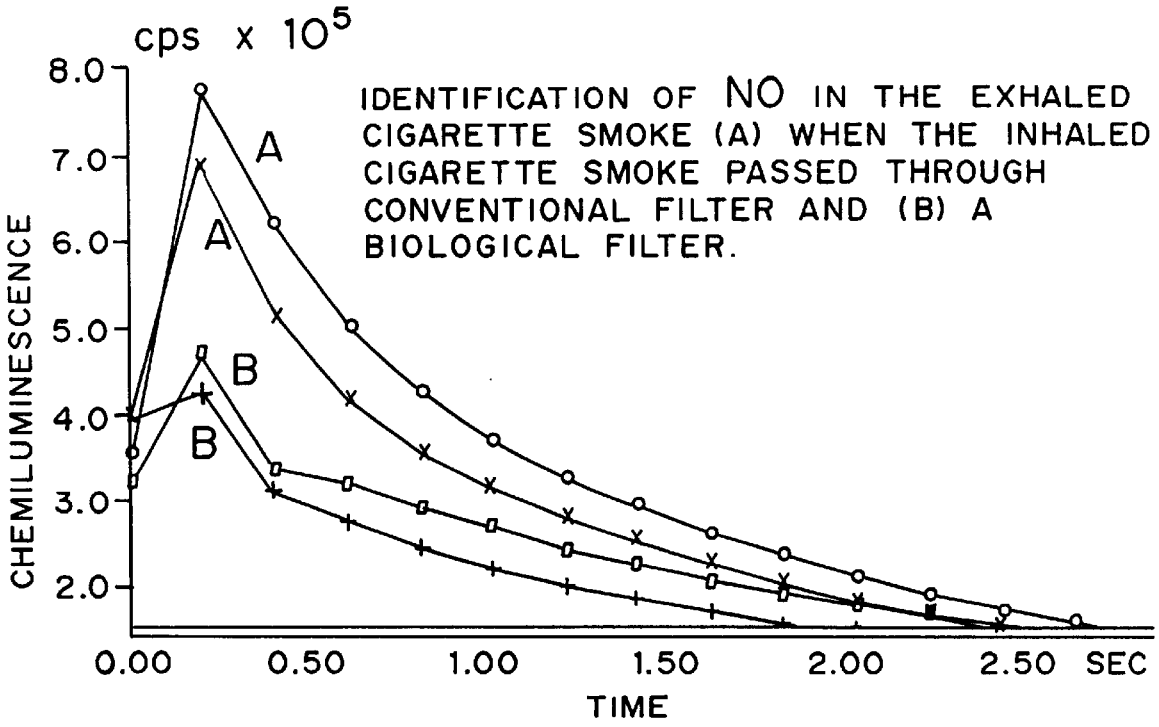
Figure 19:
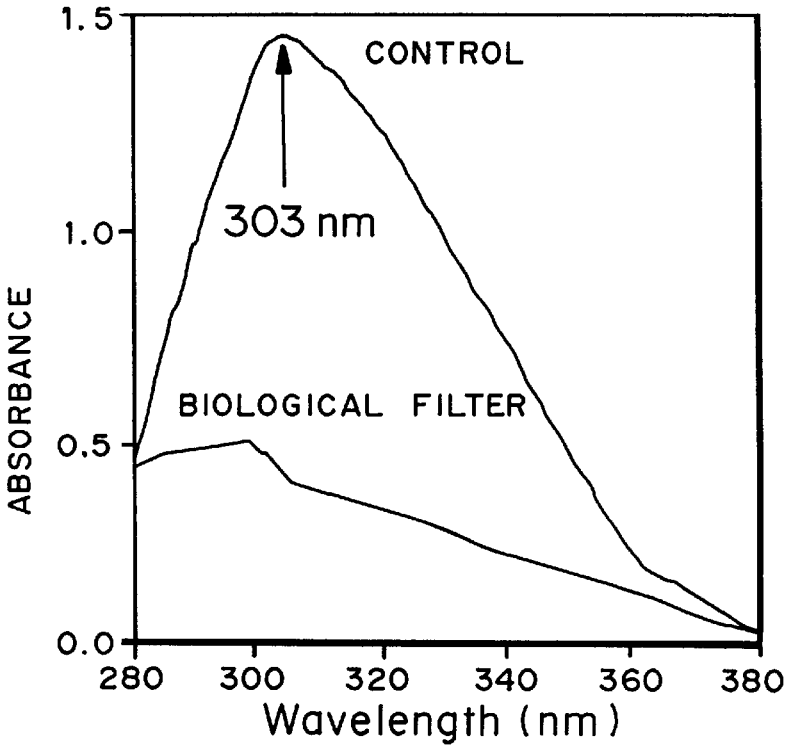

Human volunteers smoking a cigarette bearing a conventional filter NO present in the exhaled cigarette smoke was identified after the introduction of the exhaled smoke into an acid solution (50 ml) pH 4. NO concentration was estimated by the lyminol enhanced chemiluminescence method described in the experimental section, using standard curves made by commercial NO. NO concentration was found to be 0.045 mM. The experiments were repeated using biological filters and the NO concentration in the inhaled smoke was approximately 70% lower compared with the conventional filter (FIG. 18). Concentration of ONOO— was determined using a solution of NaOH 1.2M which showed an increase in absorption at 303 nm (FIG. 19) ($\epsilon_{303nm}$=1670$M^{-1}cm^{-1}$). Our experiments showed that during smoking the exhaled smoke contains large quantities of ONOO— (passage of 50 ml exhaled smoke into 5 ml NaOH 1.2M yielded a solution of 0.9 mM ONOO—). The ratio of NO/ONOO— in the exhaled smoke was determined to be 1:20.

Therefore it appears that NOx in the lung is transformed to ONOO— when it reacts with superoxide in the lung. Superoxide is released from both macrophages and redox reactions occuring in the lung during smoking. Cigarette smoke drawn by a pump does not contain ONOO—, however a quantity of NOx reacts with superoxide or oxygen to form nitrite ions ($NO_2$—). ONOO— is formed only when cigarette smoke enters the lungs. The use of biological filters reduces the exhaled quanities of NO and ONOO— by 70%.

b) ONOO— reacts with bicarbonate ions of the human erythrocytes according to the reaction

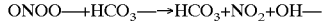

$$ONOO^- + HCO_3^- \rightarrow HCO_3 + NO_2 + OH^-$$

The bicarbonate radical oxidizes luminol as well as aromatic and heterocyclic molecules. Alternatively ONOO— may peroxidize bicarbonate to peroxybicarbonate another strong oxidizing species. On the other hand superoxide dismutase (SOD) catalyzes the nitration by ONOO— and a wide range of phenolics including tyrosine in proteins.

Figure 20:
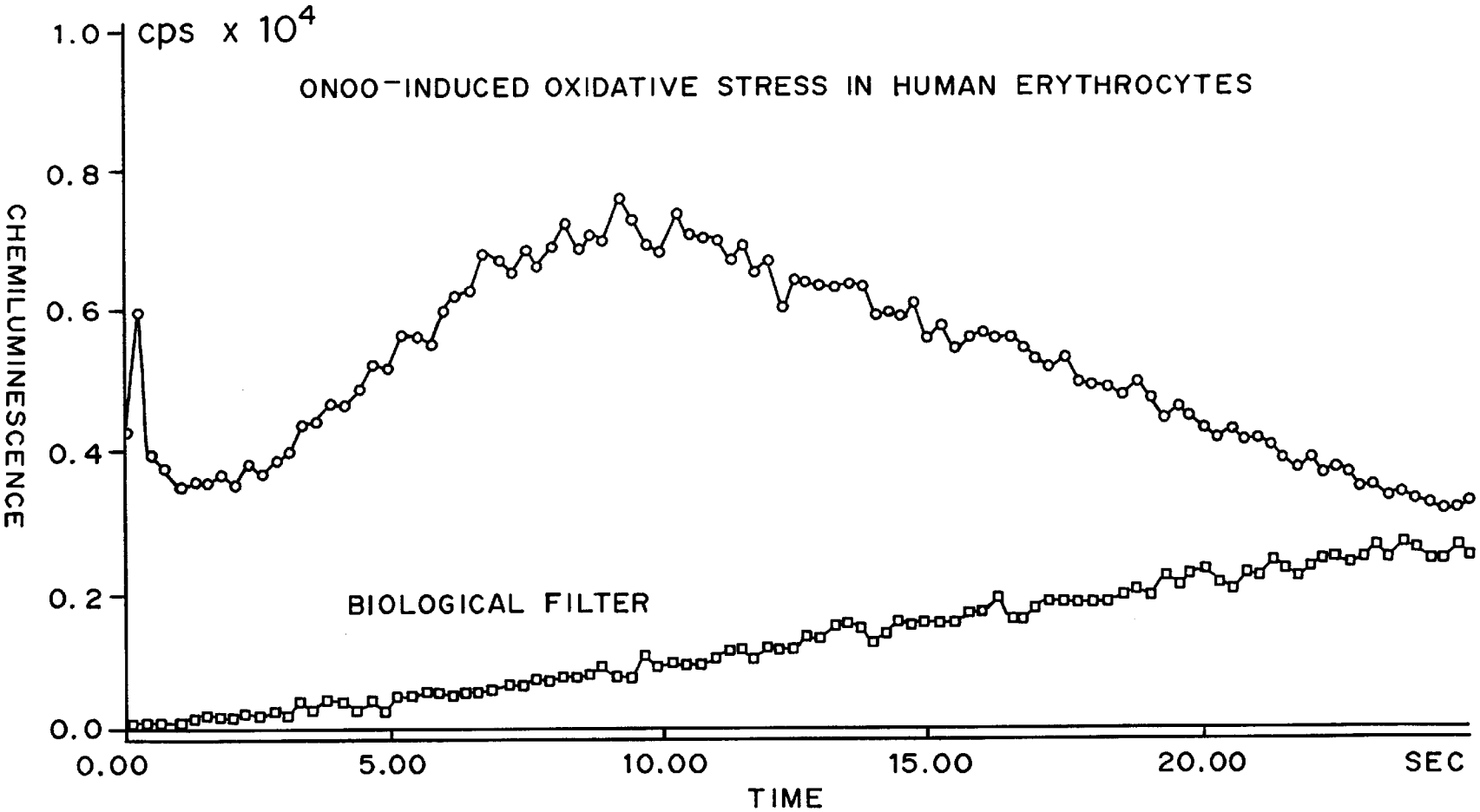
Figure 22:
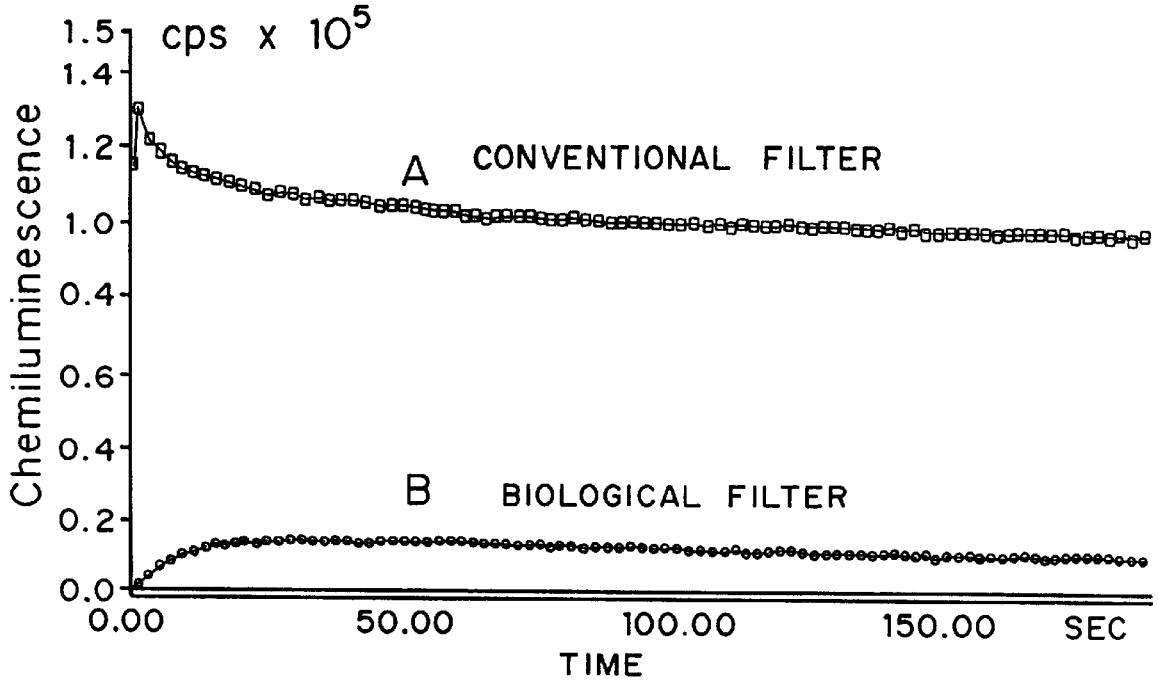
Figure 21:
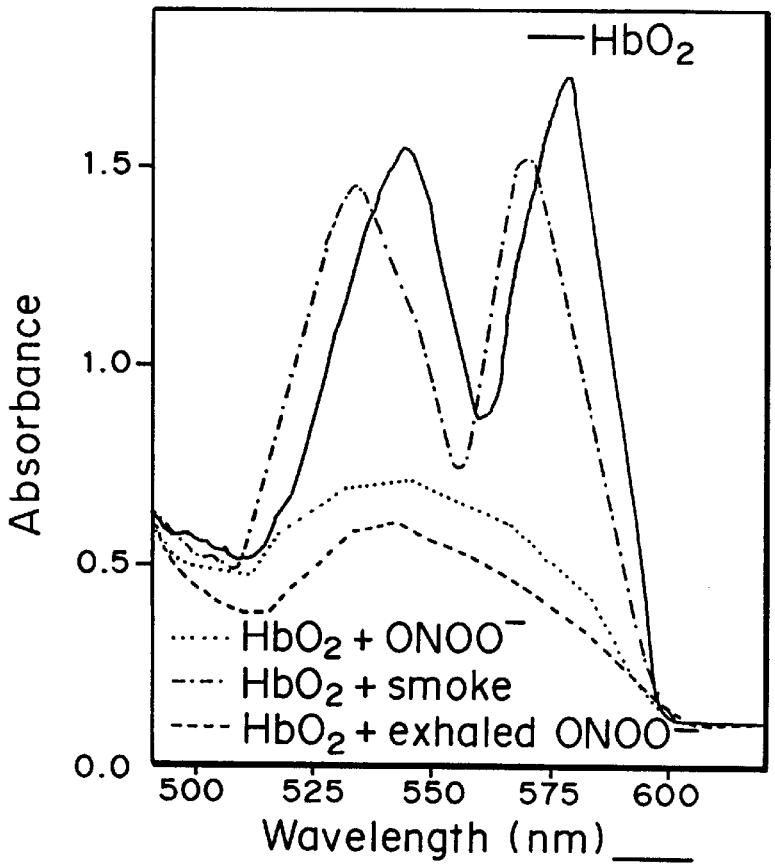
Figure 23:
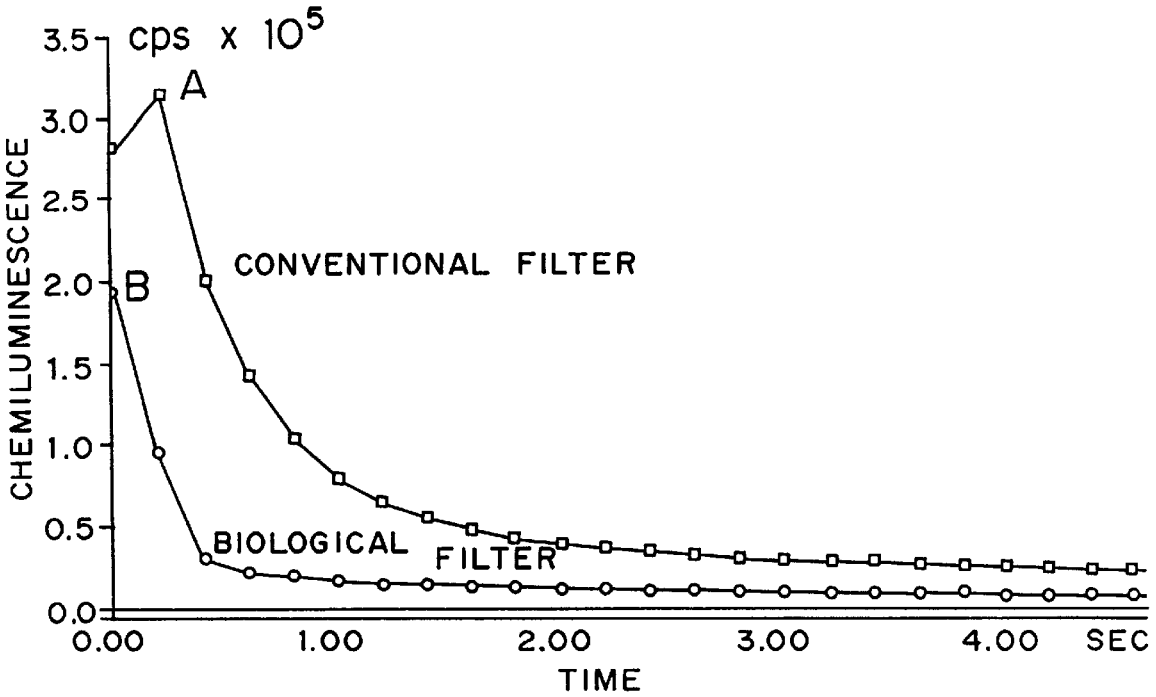
Figure 24:
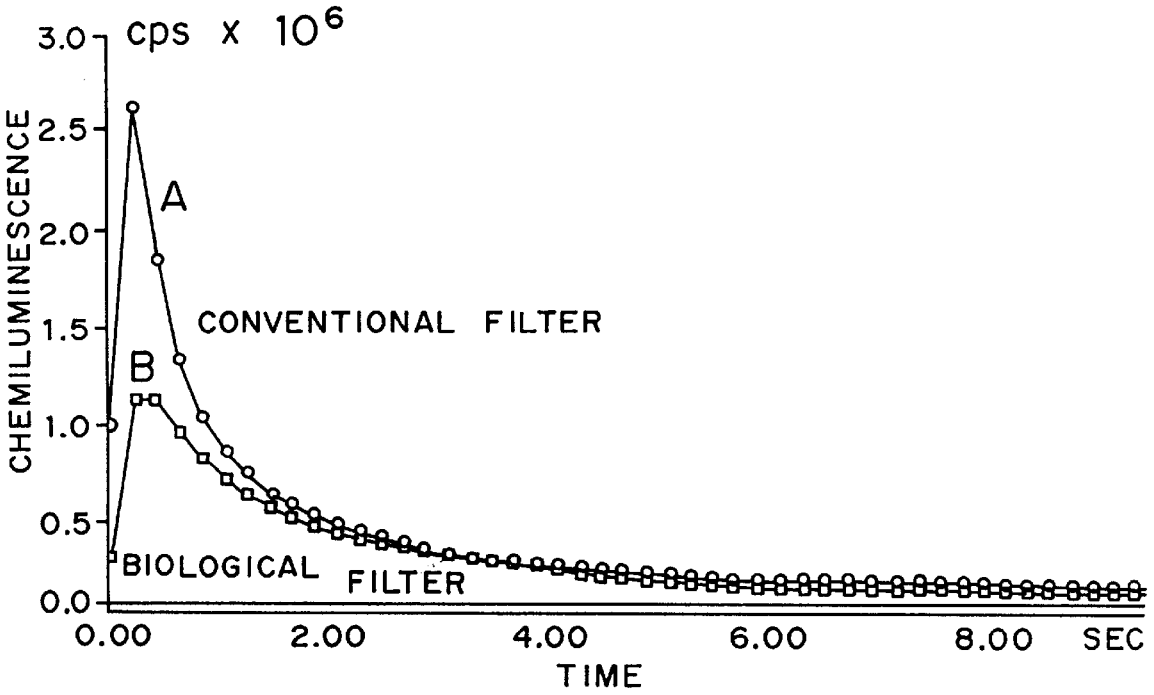

Thus there are several potential mechanisms by which bicarbonate and SOD could influence the overall reactivity of ONOO— in the cells. The presence of ONOO— formed in the lungs by inhaled cigarette smoke, exhibits a dramatic increase in the oxidative stress in erythrocytes which was detected by a chemiluminescence response occuring within 5 seconds. The same experiment conducted using a biological filter resulted in an almost 100% inhibition of oxidative stress in human erythrocytes (FIG. 20). Hemoglobin or eurythrocyte lysates exposed to ONOO— (contained in the exhaled cigarette smoke) caused the abolition of the two peaks at 540 and 575 nm normally observed in hemoglobin. The results of a representative experiment similar to the one described above was performed in 12 volunteers and is shown in FIG. 21. When hemoglobin and/or lysate were exposed to a small quantity of exhaled smoke (10 ml) a shift of the peaks from 540 and 575 to 525 and 555 nm was observed consistent with the formation of nitrosyl hemoglobin. The experiments were repeated using biological filters. The peaks observed maintained their characteristic wavelengths.

d) Aldehydes were identified in the exhaled cigarette smoke from human volunteers by their characteristic chemiluminescence peak. The experiments were repeated using biological filters and a 90% reduction of the chemiluminescent response, was observed as compared to a maximum chemiluminescence response observed when using a conventional filter (FIG. 22). It is obvious that the biological filters withhold and neutralize the aldehydes in cigarette smoke whilst retaining the oxidants, thus apparently inhibiting the initiation of redox reactions from taking place in the lung which would result in the production of endogenous aldehydes.

e) Free radicals were identified in the exhaled cigarette smoke, from human volunteers by their characteristic chemiluminescence peak. Human volunteers used cigarettes bearing conventional and biological filters. They were advised to exhaled cigarette smoke (50 ml) in an acid solution (0.01N HCl) (50 ml) pH: 6 and the chemiluminescence response was taken after 5 min and 60 min. At pH: 6 the exhaled ONOO— is spontaneously decomposed. Within 5 min there was a 160% increase of the chemiluminescence response in the exhaled smoke passed through a conventional filter as compared to cigarette smoke passed through a biological filter (FIG. 23). When the saturated by the exhaled smoke acid solution was left for an hour the difference in the chemiluminescence response increased from 160% to 250% (FIG. 24). This is consistent with the concept that redox reactions are taking place continuously in the cigarette smoke through the quinone radicals and produce a series of activated oxygen species that can cause biological damage.

COMMENTARY

Our studies have shown that alveolar macrophages possess an endogenous NO synthase, like other cells, and are capable of releasing NO/ONCO— for prolonged time periods following exposure to cigarette smoke. Furthermore, once NO begins to be released by these cells, the production of NO becomes self supporting even after the stimulus is removed. Such a reaction accounts for the ability of the cigarette smoke derived NO to stimulate alveolar macrophages in releasing NO and ONOO— for a period of several hours after the removal of the stimulus. Such a reaction may be initiated by the production of $H_2O_2$ in the lungs upon stimulation of alveolar macrophages by cigarette smoke. $H_2O_2$ may stimulate NO synthase activity of the lung cells to produce NO and ONOO— for a time period of more than an hour after the removal of the stimuli. Our experiments indeed showed that passage of cigarette smoke through a biological filter resulted in a 90% reduction (as compared to a conventional letter) of the oxidative stress in the rat alveolar macrophages. An ONOO— radical formed in the lungs may possibly attack and inactivate the a1-proteinase inhibitor (a1PI). Inhibition of the a1PI in human lungs often causes emphysema in which lung capacity is reduced. Statistical evidence indicates that smoking predisposes one to the development of emphysema (Southon, P. A., Pwis, G., Free Radicals in Medicine. Involvement in human Disease. Mayo Clin. Proc. 63: 390–408, 1988). In in vivo experiments performed in 12 volunteers smokers a 90% reduction of the exhaled NO/ONOO— was shown when the inhaled cigarette smoke was passed through a biological filter.

Oxygen free radicals have also been implicated in the pathogenesis of IgA immune complex induced alveolitis. Pretreatment of animals with superoxide dismutase, catalase, the iron chelator desferioxamine, or the hydroxyl radical scavenger DMSO, supresses the development of lung injury. In contrast, the lungs of untreated positive control animals are characterized by the presence of increased numbers of alveolar macrophages. Interstitial edema and hemorrhage are also present. Furthermore, in this model of lung injury, the L-arginine is also highly protective as demonstrated by reduced: vascular permeability; vascular hemorrhage; and injury to vascular endothelial and alveolar epithelial cells. These findings suggest that the macrophages are the source of the damage causing NO, O2—, $H_2O_2$ and OH compounds (Mullingan, M. S., Jonhson, K. J., Ward, P. A., In: "Biological Oxidants: Generation and Injurious Consequences" (eds. Cochrane, C. G., and Gilbrone, M. A., Jr. Academic Press 157–172, 1992).

The retention and neutralization of the oxidants contained in the cigarette smoke by the biological filters may play a significant role in reducing the activity of the redox enzymes which are directly related to the oxidative stress in the lung cells. Biological filters drastically reduce the oxidative stress caused by inhaled cigarette smoke. Oxidative stress in the lung macrophages and endothelial cells of the lung vessels may be induced by NO, NOx oxygen radicals and/or aldehydes contained in the cigarette smoke. Furthermore the retention of aldehydes and trace elements (especially of Cd) by the biological filters may have considerable long term effects in preserving the plasma antioxidants and in inhibiting the development of artherosclerosis. Hemoglobin contains several neutrophilic centers which undergo covalent reactions with electrophiles. These centers induce the N-terminal valine residues of the α- and β-chain, the N1 and N3 atoms of histidine residues and the sulphydryl group of cystein residues. The carcinogenic nitrosocompound 4-(methylnitrosamino)-1-(3-pyridyl)-1-butanone (NNK) present in tobacco is transferred to the smoke during burning of cigarette and its levels in mainstream smoke could vary from 4 to 1700 ng per cigarette NNIK can form adducts with hemoglobin (Hecht, S. S., Karan, S., and Carmella, S. G., in: "Human carcinogen expose" eds. Garmer, R. C., Farmer, P. B., Steel, G. I., and Wright, A. S.) IRL Press pp. 267–274, 1991). Clearly the only way to avoid tobacco-related diseases is to refrain from tobacco chewing and smoking. However, the statistics on current smokers, indicate that a strong case can be made for the need to reduce exposure to tobacco carcinogens and to modify their mode of action. Principal approaches toward this goal are:

1) modification of tobacco products, 2) inhibition of the metabolic activation of tobacco carcinogens and their endogenous formation by certain micro- and macro nutrients and chemopreventing agents and 3) retention of tobacco carcinogens using specific filters which will be adapted in the tobacco of the cigarettes. Our invention using biological substances for the manufacturing of biological filters finally concerns the discovery that nitrosocompounds present in the inhaled cigarette smoke are withheld by the biological substances protecting the health not only of the smokers but of the non-smokers as well.

We claim:

1. A filter for filtering tobacco smoke comprising a fiber matrix enriched with a biological substance selected from the group consisting of hemoglobin, lysates of erythrocytes, and combinations thereof.

2. The filter of claim 1 comprising activated charcoal enriched with the biological substance.

3. The filter of claim 1 wherein the enriched fiber matrix is flanked by fiber matrix which is not enriched with the biological substance.

4. A filter for filtering tobacco smoke comprising a fiber matrix enriched with a biological substance, wherein the biological substance is iron $Fe^{2+}$ ions bound stereospecifically to a substance selected from the group consisting of transferrin, catalase, protoporphyrin, cytochrome C, chlorophyll, and combinations thereof.

5. A filter for filtering tobacco smoke comprising a fiber matrix enriched with a biological substance selected from the group consisting of iron complexed with a porphyrin ring, copper complexed with a porphyrin ring, magnesium complexed with a porphyrin ring, iron bound stereospecifically in protein molecules, and combinations thereof, wherein the biological substance is in solid form.

6. A cigarette comprising a filter for filtering tobacco smoke wherein the filter comprises a fiber matrix enriched with a biological substance selected from the group consisting of hemoglobin, lysates of erythrocytes, and combinations thereof.

7. The cigarette of claim 6 wherein the filter comprises activated charcoal enriched with the biological substance.

8. The cigarette of claim 7 wherein the enriched fiber matrix of the filter is flanked by fiber matrix which is not enriched with the biological substance.

9. A method of making a tobacco smoke filter comprising impregnating a filter material with a biological substance selected from the group consisting of hemoglobin, lysates of erythrocytes, and combinations thereof.

10. The method of claim 9, wherein the filter comprises activated charcoal.

11. The method of claim 9 wherein the biological substance is provided in a phosphate buffered saline solution having a pH of about 7.4.

12. The method of claim 9 further comprising filtering the filter material to remove any non-absorbed biological substance.

13. The method of claim 9 wherein impregnation of the filter material with the biological substance is carried out for 30 minutes at room temperature.

14. The method of claim 9 wherein the filter material is incorporated into a tobacco smoke filter arrangement in which the filter material is flanked by fiber matrix which is not enriched with the biological substance.

15. A method of filtering tobacco smoke comprising providing a filter impregnated with a biological substance selected from the group consisting of hemoglobin, lysates of erythrocytes, and combinations thereof; and passing the tobacco smoke through the filter.

16. The method of claim 15 wherein the filter retains from 15 to 90% NO; 10 to 90% CO; 40 to 90% free radicals; 10 to 90% aldehydes; 10 to 90% carcinogenic nitroso compounds; 15 to 90% $H_2O_2$; and 50 to 95% of trace elements present in the tobacco smoke before passing through the filter.

17. The method of claim 15 wherein the filter retains from 85 to 90% NO; 80 to 90% CO; 60 to 90% free radicals; 60 to 90% $H_2O_2$; 60 to 90% aldehydes; 60 to 90% carcinogenic nitroso compounds; and 70 to 95% of the trace elements present in the tobacco smoke before passing through the filter.

18. A cigarette comprising a filter for filtering tobacco smoke wherein the filter comprises a fiber matrix enriched with a biological substance, wherein the biological substance is iron $Fe^{2+}$ ions bound stereospecifically to a substance selected from the group consisting of transferrin, catalase, protoporphyrin, cytochrome C, chlorophyll, and combinations thereof.

19. The cigarette of claim 18 wherein the filter comprises activated charcoal enriched with the biological substance.

20. A cigarette comprising a filter for filtering tobacco smoke wherein the filter comprises a fiber matrix enriched with a biological substance selected from the group consisting of iron complexed with a porphyrin ring, copper complexed with a porphyrin ring magnesium complexed with a porphyrin ring, iron bound stereospecifically in protein molecules, and combinations thereof, wherein the biological substance in the filter is in solid form.

21. The cigarette of claim 20 wherein the filter comprises activated charcoal enriched with the biological substance.

22. A method of making a tobacco smoke filter comprising impregnating a filter material with a biological substance, wherein the biological substance is iron $Fe^{2}$+ ions bound stereospecifically to a substance selected from the group consisting of transferrin, catalase, protoporphyrin, cytochrome C, chlorophyll, and combinations thereof.

23. A method of making a tobacco smoke filter comprising impregnating a filter material with a biological substance selected from the group consisting of iron complexed with a porphyrin ring, copper complexed with a porphyrin ring, magnesium complexed with a porphyrin ring, iron bound stereospecifically in protein molecules, and combinations thereof, wherein the biological substance is in solid form.

24. A method of filtering tobacco smoke comprising providing a filter impregnated with a biological substance, wherein the biological substance is iron $Fe^{2+}$ ions bound stereospecifically to a substance selected from the group consisting of transferrin, catalase, protoporphyrin, cytochrome C, chlorophyll, and combinations thereof; and passing the tobacco smoke through the filter.

25. A method of filtering tobacco smoke comprising providing a filter impregnated with a biological substance selected from the group consisting of iron complexed with a porphyrin ring, copper complexed with a porphyrin ring, magnesium complexed with a porphyrin ring, iron bound stereospecifically in protein molecules, and combinations thereof, wherein the biological substance is in solid form; and passing the tobacco smoke through the filter.

* * * * *